US010895887B1

(12) United States Patent
Aksin et al.

(10) Patent No.: US 10,895,887 B1
(45) Date of Patent: Jan. 19, 2021

(54) CURRENT MIRROR ARRANGEMENTS WITH REDUCED SENSITIVITY TO BUFFER OFFSETS

(71) Applicant: Analog Devices, Inc., Norwood, MA (US)

(72) Inventors: Devrim Aksin, Stokesdale, NC (US); Omid Foroudi, Greensboro, NC (US)

(73) Assignee: ANALOG DEVICES, INC., Norwood, MA (US)

( * ) Notice: Subject to any disclaimer, the term of this patent is extended or adjusted under 35 U.S.C. 154(b) by 0 days.

(21) Appl. No.: 16/724,212

(22) Filed: Dec. 21, 2019

(51) Int. Cl.
*G05F 3/02* (2006.01)
*G05F 3/26* (2006.01)

(52) U.S. Cl.
CPC ..... *G05F 3/262* (2013.01)

(58) Field of Classification Search
CPC ..... G05F 1/465; G05F 3/205; G05F 3/242; G05F 3/262; G05F 3/265; G05F 3/30
See application file for complete search history.

(56) References Cited

U.S. PATENT DOCUMENTS 5,079,518 A 1/1992 Wakayama
5,373,253 A 12/1994 Bailey et al.
5,656,954 A * 8/1997 Kondoh ..... H03K 3/0231 326/115
6,278,326 B1 8/2001 Murray et al.
7,295,038 B2 11/2007 Seo
7,352,235 B2 4/2008 Veenstra et al.
2002/0048109 A1* 4/2002 Chaiken ..... H03G 7/06 360/67
2003/0184386 A1 10/2003 Varner et al.
2006/0181257 A1* 8/2006 Veenstra ..... G05F 3/265 323/315
2009/0085654 A1* 4/2009 Lin ..... G05F 3/205 327/543

OTHER PUBLICATIONS

Chen et al., *Current Mirror Circuit with Accurate Mirror Gain for Low βTransistors*, ISCAS-HC, May 2001, 4 pages.
Niknejad, *Lecture 21: Voltage/Current Buffer Freq Response*, EECS 105 Fall 2003, Lecture 21, University of California, Berkley, 20 pages.

* cited by examiner

*Primary Examiner* — Long Nguyen
(74) *Attorney, Agent, or Firm* — Patent Capital Group

(57) ABSTRACT

An example current mirror arrangement includes a first portion and a second portion, each of which includes a current mirror having transistors Q1 and Q2, a buffer amplifier that has an input coupled to a base/gate terminal of Q1 and an output coupled to a base/gate terminal of Q2, a master resistor coupled to an emitter/source terminal of Q1, and a slave resistor coupled to an emitter/source terminal of Q2. Furthermore, the slave resistor of the first portion is coupled to the slave resistor of the second portion. Providing additional resistors on master and slave sides of a current mirror arrangement may advantageously allow benefiting from the use of buffers outside of a feedback loop of a current mirror while reducing the sensitivity of the current mirror arrangement to buffer offsets.

21 Claims, 8 Drawing Sheets

CURRENT MIRROR ARRANGEMENTS WITH REDUCED SENSITIVITY TO BUFFER OFFSETS

TECHNICAL FIELD OF THE DISCLOSURE

The present disclosure relates generally to electronic devices and, more particularly, to current mirror circuits.

BACKGROUND

Current mirrors are one of the few building blocks that are fundamental to the general circuit designs. In particular, broadband, linear current mirrors are one of the major founding blocks of open loop broadband linear amplifiers utilized within wide range of markets, such as communication, military, automotive, industrial.

Designing current mirrors that can mirror their input current with a constant current gain to their outputs within a wide operating bandwidth in a linear fashion and in presence of the ever increasing fundamental input signal frequency is not trivial. At a given operating frequency, linearity and signal bandwidth of a current mirror ultimately set an upper bound to the dynamic range of an amplifier, or any other circuit in which the current mirror is used. Classically, linearity is traded off with bandwidth and power. Consequently, having current mirrors that have both high linearity and wide signal bandwidth would provide a significant competitive advantage in differentiating products in a respective market.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DESCRIPTION OF EXAMPLE EMBODIMENTS OF THE DISCLOSURE

Overview

Figure 1:
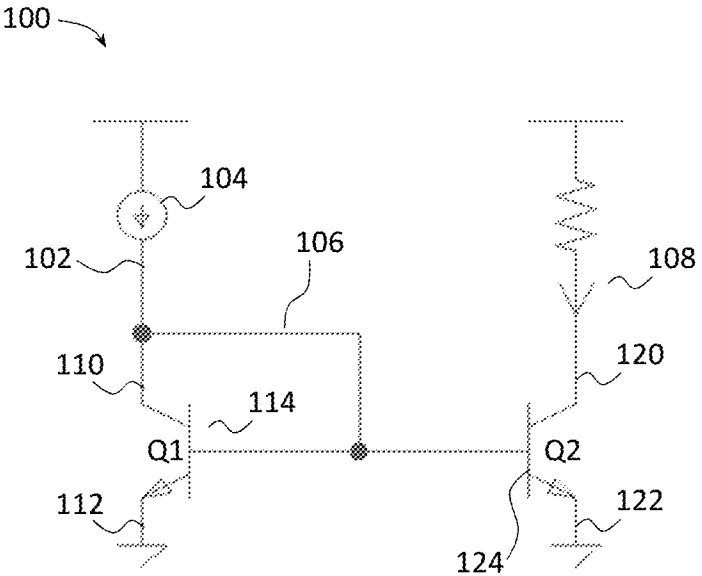
FIG. 1 (prior art)
FIG. 1 provides an electric circuit diagram of an NPN implementation of a conventional current mirror with a current gain K.

The systems, methods and devices of this disclosure each have several innovative aspects, no single one of which is solely responsible for all of the desirable attributes disclosed herein. Details of one or more implementations of the subject matter described in this specification are set forth in the description below and the accompanying drawings.

In one aspect, current mirror arrangements with buffers and additional resistors on master and slave sides are disclosed. An example arrangement includes a first portion and a second portion, each of which includes a current mirror configured to receive a respective (i.e., different) input signal (e.g., current) at an input and provide a respective output signal (e.g., current) at an output. The current mirror of each portion includes transistors Q1 and Q2, each of which includes a first, a second, and a third terminals. In each portion, the second terminal of Q1 is coupled to the input of the current mirror for the portion (i.e., coupled to the input signal for the portion) and also coupled to its own first terminal (i.e., to the first terminal of Q1), and the second terminal of Q2 is coupled to the output of the current mirror for the portion (i.e., coupled to the output signal for the portion). Each portion further includes a buffer amplifier (or, simply, a "buffer," also known as a unity gain amplifier, a buffer amplifier, a voltage follower, or an isolation amplifier) that has an input coupled to the first terminal of Q1 and an output coupled to the first terminal of Q2, a master resistor that has a first terminal coupled to the third terminal of Q1, and a slave resistor that has a first terminal coupled to the third terminal of Q2. Furthermore, the first terminal of the slave resistor of the first portion is coupled to the first terminal of the slave resistor of the second portion. Resistors are referred to herein as "master" and "slave" resistors because, for each portion, they are provided, respectively, on master and slave sides of the current mirror of the portion, where, in general, the "master side" of a current mirror may refer to a branch of a current mirror circuit where the input signal is received, and the "slave side" of a current mirror may refer to a branch of a current mirror circuit where the output signal is provided. Providing additional resistors on master and slave sides of a current mirror arrangement may advantageously allow benefiting from the use of buffers outside of a feedback loop of a current mirror (which may help solve stability issues associated with buffers included within the feedback loop of current mirrors and provide bandwidth and linearity improvements), while reducing the sensitivity of the current mirror to buffer offset due to mismatch between the master and slave sides (which could, otherwise, significantly degrade linearity). Phrased differently, by including additional resistors on master and slave sides of current mirror arrangements, as described herein, advantages of improved stability buffers may be realized because additional resistors may reduce sensitivity of the circuit to buffer offsets that may be introduced by the buffers.

In various embodiments, current mirror arrangements described herein may be implemented using bipolar technology (e.g., where various transistors may be NPN or PNP transistors), complementary metal-oxide-semiconductor (CMOS) technology (e.g., where various transistors may be NMOS or PMOS transistors), or any combination of these technologies. In view of that, in the present descriptions, the term "first terminal" of a transistor is used to refer to a base terminal if the transistor is a bipolar transistor or to a gate terminal if the transistor is a metal-oxide-semiconductor (MOS) transistor, the term "second terminal" of a transistor is used to refer to a collector terminal if the transistor is a bipolar transistor or to a drain terminal if the transistor is a MOS transistor, and the term "third terminal" of a transistor is used to refer to an emitter terminal if the transistor is a bipolar transistor or to a source terminal if the transistor is a MOS transistor. These terms remain the same irrespective of whether a transistor of a given technology is an N-type transistor (e.g., an NPN transistor if the transistor is a bipolar transistor or an NMOS transistor if the transistor is a MOS transistor) or a P-type transistor (e.g., a PNP transistor if the transistor is a bipolar transistor or a PMOS transistor if the transistor is a MOS transistor).

For each portion, a ratio of the output signal to the input signal may be substantially equal to K, where K is a current gain which may be any positive number greater than 0, which value may, but does not have to be, an integer. For the bipolar implementation embodiments, the value of K may be indicative of (e.g., be equal to or be based on) a ratio of an area of the emitter of the transistor Q2 to an area of the emitter of the transistor Q1. For the MOS implementation embodiments, the value of K may be indicative of a ratio of the aspect ratio of the transistor Q2 to the aspect ratio of the transistor Q1, where an aspect ratio of a MOS transistor may be defined as a channel width of the transistor divided by its' channel length. In the embodiments where K is greater than 0 but less than 1, multiplying by a factor of K means attenuating the input signal to generate the output signal. In the embodiments where K is greater than 1, multiplying by a factor of K means increasing, or gaining, the input signal to generate the output signal. In some embodiments, the first portion may receive the input signal in the form of a first input current $I_{INP}$, that is based on a sum of a bias current IB for the current mirror arrangement and a signal current $I_{IN}$ (e.g., $I_{INP}=IB+I_{IN}$), while the second portion may receive the input signal in the form of a second input current $I_{INM}$ that is based on a difference between the bias current IB and the signal current $I_{IN}$ (e.g., $I_{INM}=IB-I_{IN}$). Thus, the first and second portions may be portions of a differential current mirror arrangement. In such embodiments, the output current of the first portion may be $I_{OP}=K*I_{INP}$, while the output current of the second portion may be $I_{OM}=K*I_{INM}$. In other embodiments, current mirror arrangements with buffers and additional resistors on master and slave sides may be implemented as single-ended arrangements.

As will be appreciated by one skilled in the art, aspects of the present disclosure, in particular aspects of current mirror arrangements with buffers and additional resistors on master and slave sides, as described herein, may be embodied in various manners—e.g., as a method or as a system. The following detailed description presents various descriptions of specific certain embodiments. However, the innovations described herein can be embodied in a multitude of different ways, for example, as defined and covered by the claims or select examples. For example, while some of the descriptions are provided herein with respect to either bipolar (e.g., NPN or PNP implementations) or MOS (e.g., NMOS or PMOS implementations) transistors, further embodiments of the current mirror arrangements described herein may include any combinations of bipolar and MOS transistors.

In the following description, reference is made to the drawings where like reference numerals can indicate identical or functionally similar elements. It will be understood that elements illustrated in the drawings are not necessarily drawn to scale. Moreover, it will be understood that certain embodiments can include more elements than illustrated in a drawing and/or a subset of the elements illustrated in a drawing. Further, some embodiments can incorporate any suitable combination of features from two or more drawings.

With the numerous examples provided herein, interaction may be described in terms of two, three, four, or more electrical components. However, this has been done for purposes of clarity and example only. It should be appreciated that the devices and systems described herein can be consolidated in any suitable manner. Along similar design alternatives, any of the illustrated components, modules, and elements of the present drawings may be combined in various possible configurations, all of which are clearly within the broad scope of the present disclosure. In certain cases, it may be easier to describe one or more of the functionalities of a given set of flows by only referencing a limited number of electrical elements. It should be appreciated that the electrical circuits of the present drawings and its teachings are readily scalable and can accommodate a large number of components, as well as more complicated or sophisticated arrangements and configurations. Accordingly, the examples provided should not limit the scope or inhibit the broad teachings of the electrical circuits as potentially applied to a myriad of other architectures.

The description may use the phrases "in an embodiment" or "in embodiments," which may each refer to one or more of the same or different embodiments. Unless otherwise specified, the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner. Various aspects of the illustrative embodiments are described using terms commonly employed by those skilled in the art to convey the substance of their work to others skilled in the art. The terms "substantially," "approximately," "about," etc., may be used to generally refer to being within +/−20% of a target value based on the context of a particular value as described herein or as known in the art. For the purposes of the present disclosure, the phrase "A and/or B" or notation "A/B" means (A), (B), or (A and B). For the purposes of the present disclosure, the phrase "A, B, and/or C" means (A), (B), (C), (A and B), (A and C), (B and C), or (A, B, and C). The term "between," when used with reference to measurement ranges, is inclusive of the ends of the measurement ranges. As used herein, the notation "A/B/C" means (A, B, and/or C).

Basics of Current Mirrors

For purposes of illustrating current mirror arrangements with buffers having improved stability assisted by including additional resistors on master and slave sides, proposed herein, it might be useful to first understand phenomena that may come into play when current is mirrored. The following foundational information may be viewed as a basis from which the present disclosure may be properly explained.

Such information is offered for purposes of explanation only and, accordingly, should not be construed in any way to limit the broad scope of the present disclosure and its potential applications.

FIG. 1 provides an electric circuit diagram of a simple single-ended NPN bipolar transistor implementation of a current mirror 100 with a current gain of K, as known in the art. As shown in FIG. 1, the current mirror 100 may include a first transistor Q1 (which may be referred to as an "input transistor") and a second transistor Q2 (which may be referred to as an "output transistor"). An input current 102 ($I_{IN}$) (i.e, the current to be mirrored at the output of the current mirror 100 to generate an output current 108) may be provided by an input current source 104. The current mirror 100 may first generate a control voltage (voltage VN1) at a node 106 (node N1) by placing the transistor Q1 in feedback to force the current at a collector terminal 110 (or, simply, "collector" 110) of the transistor Q1 to be equal to the input current 102. An emitter terminal 112 (or, simply, "emitter" 112) of the transistor Q1 may be connected to ground, as shown in FIG. 1. A base terminal 114 (or, simply, "base" 114) of the transistor Q1 may be coupled to a base 124 of the transistor Q2. The base 124 of the output transistor Q2 may be driven with the voltage VN1 carrying the input current information to generate the output current 108. FIG. 1 also indicates a collector 120 of the transistor Q2 and an emitter 122 of the transistor Q2, where the emitter 122 may be coupled to ground and where the output current 108 is the current at the collector 120, as shown in FIG. 1. When the emitter area of the transistor Q2 is K times larger than that of the transistor Q1, the output current 108 ($I_O$) may be equal to $K \cdot I_{IN}$.

The simplified model of a bipolar transistor collector current is given by $$I_C = AI_S \exp\left(\frac{V_{BE}}{V_t}\right)$$

where $I_C$, A, $I_S$, $V_{BE}$ and $V_t$ are collector current, emitter area, unit area saturation current, the base-emitter voltage and thermal voltage, respectively. Although the relation between collector current ($I_C$) to base-emitter voltage ($V_{BE}$), or, equivalently input current $I_{IN}$ and VN1, is strongly nonlinear, the input-output current mirroring relation is linear, i.e. $I_O = K \cdot I_{IN}$.

Figure 2:
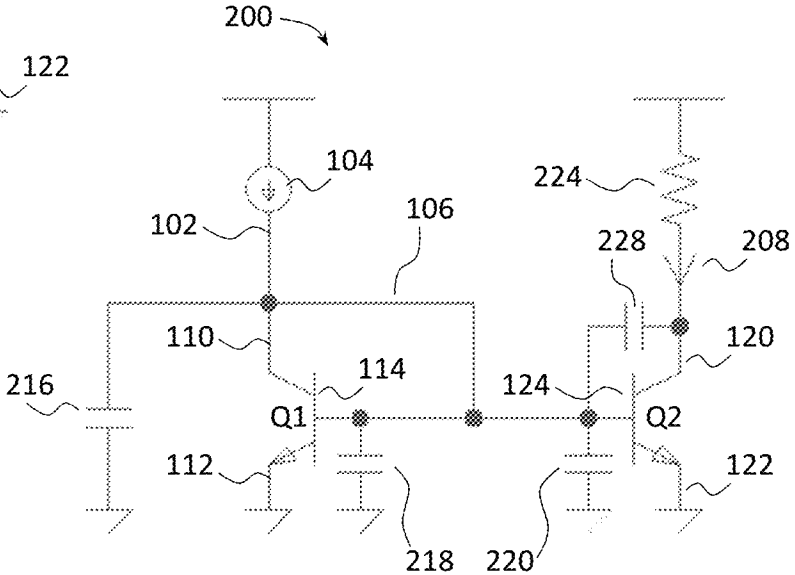
FIG. 2 (prior art)
FIG. 2 provides an electric circuit diagram of an NPN implementation of a current mirror of FIG. 1, additionally illustrating relevant parasitic components for high operating frequencies.

The basic analysis given above has many shortcomings in understanding the performance degradation of current mirrors at high operating frequencies. FIG. 2 provides an electric circuit diagram of an NPN implementation of a current mirror 200. The current mirror 200 is substantially the same as the current mirror circuit 100 of FIG. 1, except that it additionally illustrates relevant parasitic components for high operating frequencies. In other words, FIG. 2 illustrates important parasitic devices that may degrade the bandwidth and the linearity of the circuit 100. It is to be understood that parasitic components shown in the present drawings and discussed herein refer to components which are not deliberately fabricated in a circuit, but, rather, electric circuit diagram representations of inadvertent effects or behavior that may be exhibited by a circuit.

Elements of FIG. 2 having reference numerals shown in FIG. 1 are intended to illustrate the same or analogous elements as those described with respect to FIG. 1, so that, in the interest of brevity, their descriptions are not repeated. This is applicable to other figures of the present disclosure—elements with reference numerals described with reference to one figure may be the same or analogous as elements with the same reference numerals shown in another figure, so that descriptions provided for one figure are applicable to the other figure and don't have to be repeated.

The current mirror 200 may be affected by one of more of a parasitic capacitance 216, a parasitic capacitance 218, a parasitic capacitance 220, a parasitic capacitance 228, and a resistance 224 (which may be used to convert the output current of the current mirror to voltage), each of which coupled as shown in FIG. 2.

The parasitic capacitance 216 may represents all routing parasitic capacitances associated with the node 106, parasitic capacitance of 104 input current source loading node 106, as well as collector-substrate capacitance and extrinsic base terminal parasitic capacitors of the transistors Q1 and Q2. Note that the modern SOI process based bipolar transistor collector-substrate capacitor is relatively small and can be treated as being linear. The parasitic capacitance 218 may represent the intrinsic base-emitter forward-bias diffusion capacitance of the transistor Q1. The parasitic capacitance 220 may represent the intrinsic base-emitter forward-bias diffusion capacitance of the transistor Q2 (and may be K times larger than the parasitic capacitance 218 if the emitter area of the transistor Q2 is K times larger than that of the transistor Q1). The parasitic capacitance 228 may represent the intrinsic base-collector junction parasitic capacitance of the transistor Q2. The resistance 224 may represent an output resistance (RO) of the current mirror 100/200.

Inventors of the present disclosure realized that, as can be seen from the analysis of the circuit in FIG. 2, three distinct mechanisms degrading the bandwidth and/or the linearity of the current mirror may be identified for bipolar transistor implementations. One is bandwidth degradation due to the parasitic capacitors. Another one is linearity degradation due to nonlinearity of the intrinsic base-collector junction parasitic capacitance (e.g., the parasitic capacitance 228, shown in FIG. 2). The third one is linearity degradation due to linear parasitic capacitance 216. Similarly, a number of linearity degradation mechanisms may be identified for MOS transistor implementations of current mirror circuits. One degradation mechanism for the MOS implementations is bandwidth degradation due to the parasitic capacitors, similar to the bipolar implementations. Another one is linearity degradation due to linear capacitive load on node 106. The third one is linearity degradation due to gate-drain capacitance $C_{GD}$. Inventors of the present disclosure further realized that improving on at least some of these degradation mechanisms could provide an improvement in terms of designing linear broadband current mirrors.

Current Mirror Arrangements with Buffers

Figure 3:
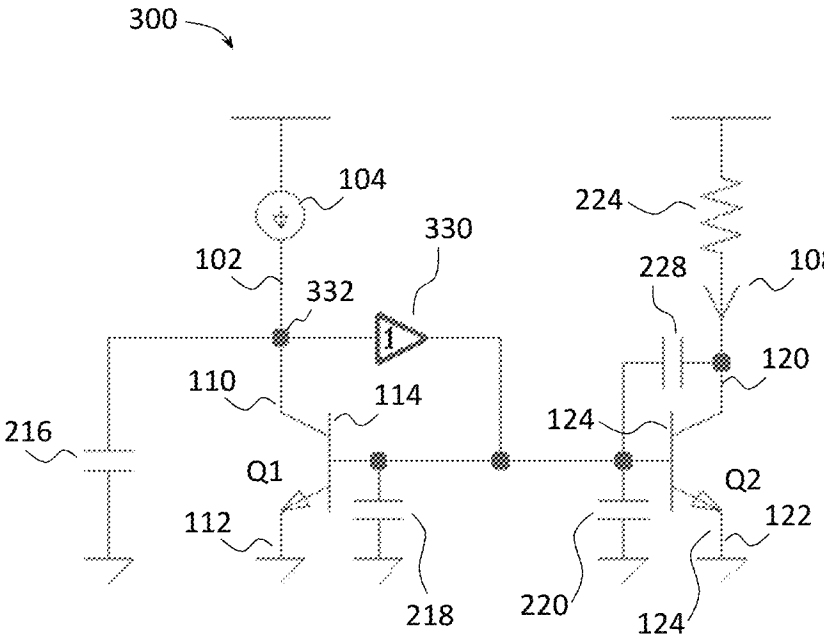
FIG. 3 (prior art)
FIG. 3 provides an electric circuit diagram of an NPN implementation of a conventional current mirror with a buffer in a feedback path.

A typical solution to overcome the limitation(s) associated with high operating frequencies (thus overcoming the bandwidth limitations) of a simple current-mirror is to add a buffer between the collector of the transistor Q1 and the bases of the transistors Q1 and Q2, as shown in FIG. 3.

FIG. 3 provides an electric circuit diagram of an NPN implementation of a current mirror 300 with a buffer 330 in a feedback path (i.e., a path between the collector 110 of the transistor Q1 and the base 114 of the transistor Q1). The current mirror 300 is substantially the same as the current mirror circuit 200 of FIG. 2, except that it additionally illustrates the buffer 330. Such a modification of the current mirror 200 may drastically reduce capacitance across the diode-connected transistor Q1 and, therefore, significantly improve the bandwidth of the circuit. Buffering may also improve the linearity of the circuit by reducing the impacts of the parasitic capacitances portion of 216 associated with the transistor Q2 and the parasitic capacitance 228. For example, buffering may lower the impact of the nonlinear currents associated with the parasitic capacitance 228 by (K+1) times. However, the non-idealities of the buffer 330 itself may make the stability of the circuit 300 challenging (note that node 332 may be a high impedance node for this configuration) such that by the time the circuit 300 is made stable, the high-frequency performance is not that much better than of the circuit 200.

Figure 4:
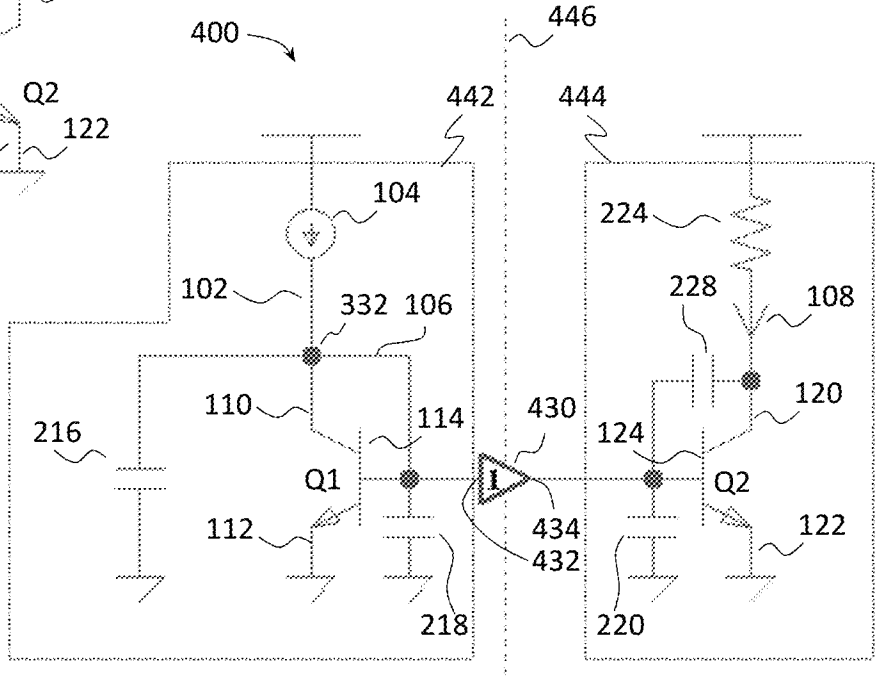
FIG. 4 (prior art)
FIG. 4 provides an electric circuit diagram of an NPN implementation of a conventional current mirror with a buffer between base terminals of transistors Q1 and Q2.

In some implementations, the buffer 330 can be moved outside the feedback loop such that the stability is no longer an issue. This is shown in FIG. 4, providing an electric circuit diagram of an NPN implementation of a current mirror 400 with a buffer 430 between the base terminals of the transistors Q1 and Q2. The buffer 430 may be a unity gain amplifier, a buffer amplifier, a voltage follower, or an isolation amplifier.

In FIG. 4 and subsequent drawings, the "master side" may refer to components of a given current mirror shown to the left of the buffer between the base or gate terminals of the transistors Q1 and Q2 (the master side labeled in FIG. 4 as a portion 442 within a dotted contour), i.e., to the left of a vertical dashed line 446 shown in FIG. 4, while the "slave side" may refer to components of a given current mirror shown to the right of that buffer (the slave side labeled in FIG. 4 as a portion 444 within a dotted contour), i.e., to the right of the line 446. The current mirror 400 is substantially the same as the current mirror circuit 200 of FIG. 2, except that it additionally illustrates the buffer 430 provided between the master side 442 and the slave side 444. As shown in FIG. 4, in such a configuration, the collector 100 and the base 114 of the transistor Q1 are shorted and connected to an input 432 of the buffer 430, while an output 434 of the buffer 430 is connected to the base 124 of Q2. Compared to the buffer 330 shown in the arrangement of FIG. 3, although moving the buffer out of the feedback loop to implement it as the buffer 430 may solve the stability issue and provide bandwidth and linearity improvements, the buffer 430 may be associated with an offset that may become an issue in this scenario since it may cause the standing current in the transistor Q2 to be off, degrading linearity due to mismatch between the master side and the slave side. As is known in the art, a buffer is, basically, a component that is supposed to regenerate an output voltage substantially identical to its input voltage (i.e., gain should be equal to 1). As also known in the art, an offset error (or, simply, "offset") is one type of non-idealities of buffers, where the offset error modifies the transfer function of a buffer from being desired y=x (where y is an output of the buffer and x is the input of the buffer) to y=x+off, where "off" is the buffer offset. Thus, in general, buffer offset refers to a DC quantity (i.e., not frequency-dependent) meaning that if a buffer has infinite bandwidth then when the input voltage is subtracted from the output voltage of the buffer then the difference will be equal to the offset voltage for any input frequency.

Current Mirror Arrangements with Buffers and Additional Resistors

In general, different techniques may be implemented to improve on one or more of the problems described above, where some tradeoffs may have to be made, e.g., in trading performance with complexity. Embodiments of the present disclosure aim to address/limit the nonlinearity and the bandwidth degradation related to one or more of the base-emitter junction parasitic capacitance 220 of the transistor Q2, part of the parasitic capacitance 216 associated with the transistor Q2, and the miller-amplified base-collector junction parasitic capacitance 228 of the transistor Q2, described above. The nonlinear base-collector junction parasitic capacitance can be quite large due to the large quiescent current at the output of the current mirror, common for broadband designs. The base-collector junction parasitic capacitance may convert the output signal swing to a non-linear current at the output node and load the diode side of the current mirror, hence degrading the overall linearity, as well as also reducing the current mirror bandwidth due to miller effect. Embodiments of the present disclosure are based on recognition that implementing buffering in current mirror arrangements may provide an improvement with respect to reducing nonlinearity related to the base-collector junction parasitic capacitance 228 of the transistor Q2 and the base-emitter junction parasitic capacitance 220.

More specifically, embodiments of the present disclosure are based on recognition that the issue of the standing current and buffer offset, described above, may be addressed by reducing the sensitivity of the transistor standing current to buffer offset. In particular, embodiments of the present disclosure are based on using resistors, which may be referred to as "degeneration resistors," properly sized and coupled to the emitter/source terminals of the transistors Q1 and Q2, so that the impact of the buffer offset of the buffer 430 on the standing current of the transistor Q2 may be contained within acceptable limits (i.e., so that sensitivity of the current mirror arrangement's linearity to any buffer offsets which may, inadvertently, be present due to inclusion of one or more buffers, may be reduced).

Figure 5:
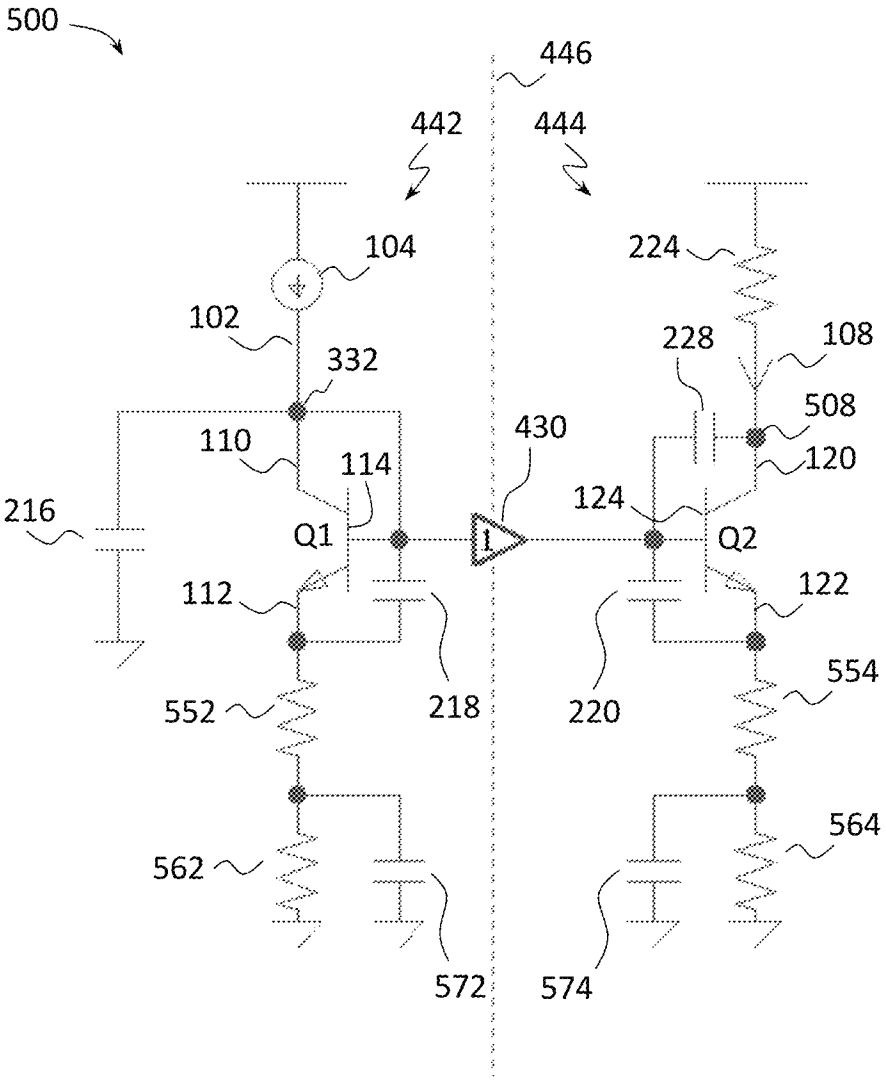
FIG. 5 provides an electric circuit diagram of an NPN implementation of a single-ended current mirror arrangement with a buffer and additional resistors on master and slave sides, according to some embodiments of the disclosure.

FIG. 5 provides an electric circuit diagram of an NPN implementation of a single-ended current mirror arrangement 500 with the buffer 430 and additional resistors on the master and slave sides 442, 444, according to some embodiments of the disclosure. The current mirror arrangement 500 is configured to receive an input current 102 ($I_{IN}$), e.g., at the input 332 to the current mirror formed by the transistors Q1 and Q2, and generate a mirrored current ($I_O$) 108, e.g., at an output 508, where $I_O$=K*$I_{IN}$, where K is a number greater than 0 (which value may, but does not have to be, an integer), indicative of a ratio of an area of the emitter of the transistor Q2 to an area of the emitter of the transistor Q1.

The current mirror 500 is substantially the same as the current mirror circuit 400 of FIG. 4, except that it further illustrates a first master resistor 552, a second master resistor 562, and a master capacitor 572 on the master side 442 of the current mirror arrangement 500, and further illustrates a first slave resistor 554, a second slave resistor 564, and a slave capacitor 574 on the slave side 444. Together, the first and second master resistors 552, 562, and the master capacitor 572 may be referred to as a "master set" while the first and second slave resistors 554, 564, and the slave capacitor 574 may be referred to as a "slave set." The first master resistor 552 and the first slave resistor 554 are optional in that one or both of the first master resistor 552 and the first slave resistor 554 may be excluded from some embodiments of the current mirror arrangement 500. Together, the buffer 430, the master set, and the slave set may be referred to as a "buffer arrangement."

As shown in FIG. 5, on the master side 442, a first terminal of the first resistor 552 may be coupled to the emitter 112 of the transistor Q1 and a second terminal of the first resistor 552 may be coupled to a first terminal of the resistor 562, while a second terminal of the resistor 562 may be coupled to the ground potential. Similarly, on the slave side 444, a first terminal of the first resistor 554 may be coupled to the emitter 122 of the transistor Q2 and a second terminal of the first resistor 554 may be coupled to a first terminal of the resistor 564, while a second terminal of the resistor 564 may be coupled to the ground potential. Thus, the second master resistor 562 may be in electrical series with the first master resistor 552, and the second slave resistor 564 may be in electrical series with the first slave resistor 554.

Resistance values of the resistors of the master and slave sets may be carefully set so that the first master and slave resistors 552, 554 may be used for setting the AC degeneration, while the second master and slave resistors 562, 564 may be used to make the standing current in the transistor Q2 insensitive to the offset of the buffer 430. To that end, the resistance of the first master resistor 552 may be selected to be smaller than the resistance of the second master resistor 562. From design perspective, in some embodiments, the procedure for selecting resistance values for the first and second master resistors 552, 562 may be as follows. The sum of resistance values of the first and second master resistors 552, 562 may be determined with respect to maximum allowed voltage drop between the node 332 and ground or available headroom. The value of the first master resistor 552 may be chosen to be minimum, which may ensure achieving relatively homogenous emitter current distribution for the transistors Q1 and Q2, while the value of the second master resistor 562 may be larger than that of the first master resistor 552. For example, in some implementations, the value of the second master resistor 562 may be at least about 2-10 times larger, e.g., at least about 5-8 times larger than the value of the first master resistor. Because the value of the first master resistor 552 may be chosen to be minimum, in some embodiments, the first master resistor 552 may be omitted altogether and the resistance of the interconnect between the emitter 112 of the transistor Q1 and the second resistor 562 may have sufficient resistance to effectively serve as the first master resistor 552. In some implementations, the relatively large value of the resistance of the second master resistor 562 may degrade the linearity of the current mirror, which is undesirable. Therefore, in some embodiments, the master capacitor 572 may be added across the second master resistor 562, the master capacitor 572 sized to roll off the voltage signal at the input 332 of the current mirror at frequencies of interest. In some embodiments, the corner frequency set by the master resistor 562 and the master capacitor 572 should be chosen low enough so that the linearity of the current mirror arrangement does not degrade within the frequencies of interest. In some embodiments, a first electrode of the master capacitor 572 may be coupled to the first terminal of the second master resistor 562 and/or the second terminal of the first master resistor 552 and/or some intermediate node between these two, while a second electrode of the master capacitor 572 may be coupled to the ground potential, as shown in FIG. 5.

In some embodiments, there may be interdependence between the values of the components of the master set and those of the slave set. In particular, in some embodiments where K is greater than 1, resistance values of the first and second slave resistors 554, 564 may be smaller, e.g., about K times smaller, than those of, respectively, the first and second master resistors 552, 562, while in some embodiments where K is between 0 and 1, resistance values of the first and second slave resistors 554, 564 may be bigger, e.g., about 1/K times bigger, than those of, respectively, the first and second master resistors 552, 562. Again, for the bipolar implementation as the one shown in FIG. 5, the value of K may be indicative of a ratio of an area of the emitter 122 of the transistor Q2 to an area of the emitter 112 of the transistor Q1. Thus, in some embodiments, the resistance value of the first slave resistor 554 multiplied by K may be substantially equal to the resistance value of the first master resistor 552, and/or the resistance value of the second slave resistor 564 multiplied by K may be substantially equal to the resistance value of the second master resistor 562. On the other hand, the capacitance value of the slave capacitor 574 divided by K may be substantially equal to the capacitance value of the master capacitor 572 in some embodiments.

FIG. 5 illustrates one embodiment of a single-ended implementation of a current mirror arrangement with a buffer between the transistors Q1 and Q2 of the current mirror and with additional resistors on master and slave sides. In other embodiments, with modifications that would be apparent to a person of ordinary skill in the art based on the descriptions provided herein, the current mirror arrangement 500 may be modified to replace NPN transistors Q1 and Q2 with PNP transistors, and/or to replace bipolar transistors Q1 and Q2 with either NMOS or PMOS transistors, all of which implementations being within the scope of the present disclosure.

In some embodiments, current mirror arrangements with buffers between the transistors Q1 and Q2 of the current mirror and with additional resistors on master and slave sides may be implemented as differential-signal circuits. Some such embodiments are shown in FIGS. 6-9. The differential-signal embodiments may be particularly advantageous in that they may save valuable die area by substantially reducing the size of the master capacitor 572 and removing altogether the need for the slave capacitor 574 by exploiting the differential nature of the input signals.

Figure 6:
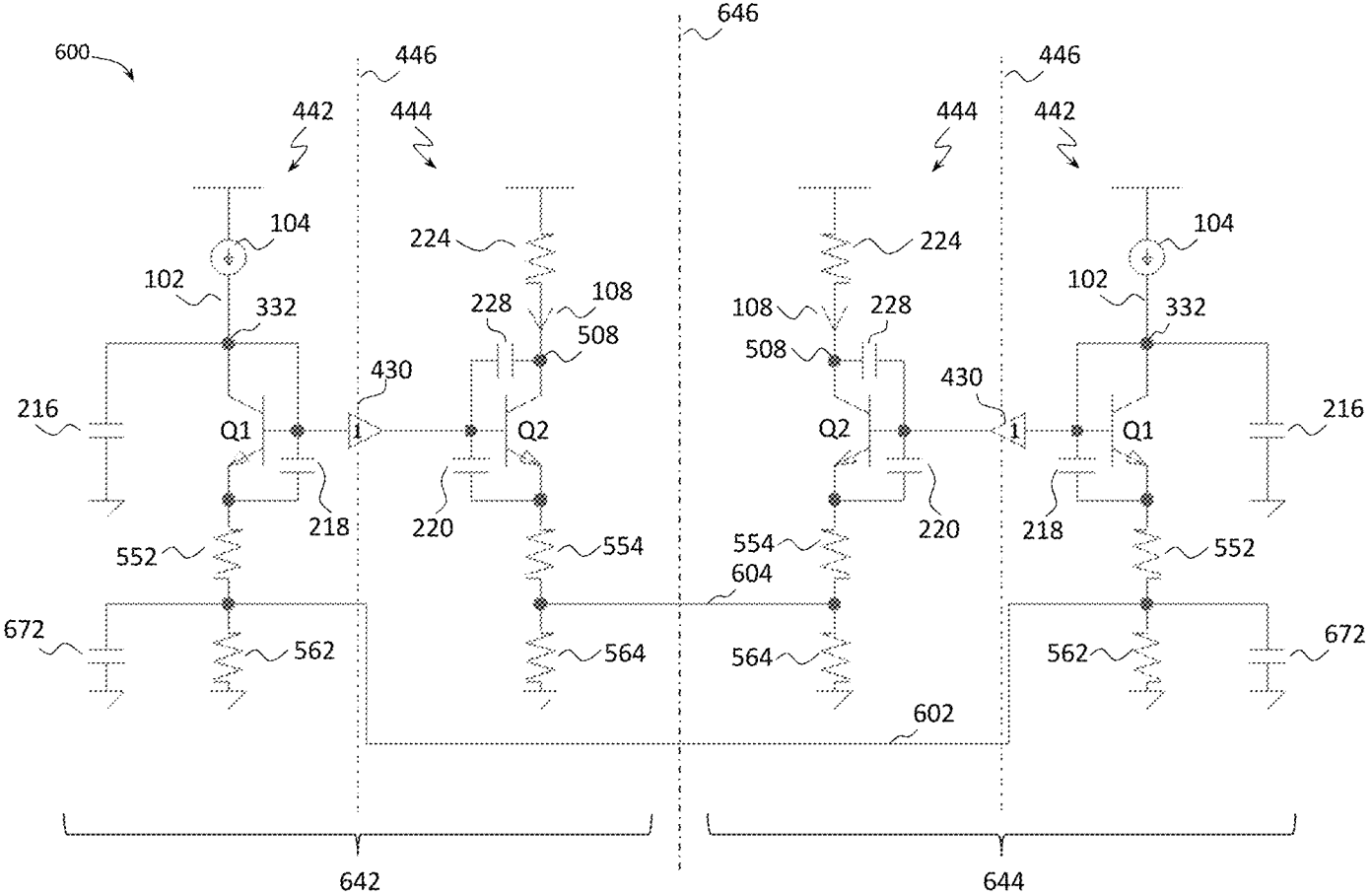
FIG. 6 provides an electric circuit diagram of an NPN implementation of a differential current mirror arrangement with buffers and additional resistors on master and slave sides, according to some embodiments of the disclosure.

FIG. 6 provides an electric circuit diagram of an NPN implementation of a differential current mirror arrangement 600 with the buffer 430 and additional resistors on the master and slave sides 442, 444, according to some embodiments of the disclosure. Since the current mirror arrangement 600 is differential, it includes two portions configured to receive complementary input signals, shown in FIG. 6 as a first portion 642 and a second portion 644, illustrated in FIG. 6 to be, respectively, to the left and to the right of a vertical dashed-dotted line 646. In some embodiments, the first portion 642 may receive the input signal 102 in the form of a first input current $I_{INP}$ that is based on a sum of a bias current IB for the current mirror arrangement 600 and an input signal current $I_{IN}$ (e.g., $I_{INP}=IB+I_{IN}$), while the second portion 644 may receive the input signal in the form of a second input current $I_{INM}$ that is based on a difference between the bias current IB and the input signal current $I_{IN}$ (e.g., $I_{INM}=IB \cdot I_{IN}$). Thus, the first portion 642 may be referred to as a "positive signal path side" and the second portion 644 may be referred to as a "negative signal path side." In such embodiments, the output current 108 of the first portion 642 may be $I_{OP}=K*I_{INP}$, while the output current 108 of the second portion 644 may be $I_{OM}=K*I_{INM}$.

Each of the first and second portions 642, 644 may include substantially the current mirror arrangement 500 as described with reference to FIG. 5, except for a few differences which will now be described.

First of all, the portion 644 is shown in FIG. 6 to be a mirror reflection of the portion 642. This may be done for the ease of illustration and, in general, the layout of the electric circuit diagram shown in FIG. 6, as well as in other drawings of the present disclosure, may not have any relation to the layout of the actual components of an IC circuit in a product.

Second, in order to not clutter the drawing of FIG. 6, the first terminal (base) 114, the second terminal (collector) 110, and third terminal (emitter) 112 of the transistor Q1, as well as the first terminal (base) 124, the second terminal (collector) 120, and third terminal (emitter) 122 of the transistor Q2, are not specifically labeled in FIG. 6.

Third, each of the first and second portions 642, 644 includes the master side 442 and the slave side 444, including master and slave resistors as described above, except that, due to the differential nature of the arrangement 600, the slave capacitor 574 may be eliminated in the current mirror arrangement 500 of each of the first and second portions 642, 644, and the master capacitor 572 may be replaced with a capacitor 672 in each of the first and second portions 642, 644. Instead of providing the slave capacitor 574 of FIG. 5 across the second slave resistor 564 in each of the first and second portions 642 and 644, in the current mirror arrangement 600 of FIG. 6 the first terminal of the second slave resistor 564 of the first portion 642 may be coupled to the first terminal of the second slave resistor 564 of the second portion 644, as shown in FIG. 6 with a connection 604. When both the first and second slave resistors 554, 564 are used on the slave side of each portion, the connection 604 may be implemented by coupling (e.g., shorting) a connection between the first and second slave resistors 554, 564 of the first portion 642 to a connection between the first and second slave resistors 554, 564 of the second portion 644, causing the connection 604 to be a virtual ground on the slave side for the respective differential input signals $I_{INP}$, and $I_{INM}$. Similar coupling may be done between the master sides of the first and second portions 642, 644: the first terminal of the second master resistor 562 of the first portion 642 may be coupled to the first terminal of the second master resistor 562 of the second portion 644, as shown in FIG. 6 with a connection 602. When both the first and second master resistors 552, 562 are used on the master side of each portion, the connection 602 may be implemented by coupling (e.g., shorting) a connection between the first and second master resistors 552, 562 of the first portion 642 to a connection between the first and second master resistors 552, 562 of the second portion 644, causing the connection 602 to be a virtual ground on the master side for the respective differential input signals $I_{INP}$, and $I_{INM}$. This way the voltage signal at the input of the current mirror may be limited to that set by the first master and slave resistors 552, 554, while the standing current in the transistor Q2 may be desensitized from the offset of the buffer 430 by the sum of the first and second resistors 552 and 652.

The capacitor 672 in each of the first and second portions 642, 644, shown in FIG. 6, is an optional component that may be included to reduce high frequency peaking at the outputs 508 due to the parasitic inductance on the master side of the virtual ground connection (e.g., the connection 602) increasing the effective degeneration resistance seen at high frequencies. Similar to the master capacitor 572, the capacitor 672 may be added across the second master resistor 562, in each of the first and second portions 642, 644. When the capacitor 672 is used, then, in each of the first and second portions 642, 644, a first electrode of the capacitor 672 may be coupled to the first terminal of the second master resistor 562 and/or the second terminal of the first master resistor 552 and/or some intermediate node between these two, while a second electrode of the capacitor 672 may be coupled to the ground potential, as shown in FIG. 6. In some embodiments, the second master resistor 562 and the master capacitor 672 may be selected so that the corner frequency set by the second master resistor 562 and the master capacitor 672 is such as to reduce or eliminate the high frequency peaking.

To summarize some aspects of the current mirror arrangement 600 shown in FIG. 6, if all base terminals of the transistors are referred to as "first terminals," all collector terminals of the transistors are referred to as "second terminals," and all emitter terminals of the transistors are referred to as "third terminals," then the following holds. The current mirror arrangement 600 is a differential arrangement, configured to process differential signals. To that end, the arrangement 600 includes two portions which receive different input signals—the first portion 642 is configured to receive the input signal 102 in the form of a first input current $I_{INP}$ that is based on a sum of a bias current IB for the current mirror arrangement 600 and an input signal current $I_{IN}$ (e.g., $I_{INP}$=IB+$I_{IN}$), while the second portion 644 is configured to receive the input signal 102 in the form of a second input current $I_{INM}$ that is based on a difference between the bias current IB and the input signal current $I_{IN}$ (e.g., $I_{INM}$=IB−$I_{IN}$). Each of the portions 642, 644 is configured to provide a current at the output that is mirrored with a factor K with respect to the input current received by the portion. For example, the first portion 642 may generate the output current $I_{OP}$=K*$I_{INP}$, where K is a number greater than 0 (which value may, but does not have to be, an integer), indicative of a ratio of an area of the emitter of the transistor Q2 to an area of the emitter of the transistor Q1, while the second portion 644 may generate the output current $I_{OM}$=K*$I_{INM}$. The first portion 642 includes a current mirror formed by the transistors Q1 and Q2, where the second terminal 110 of the transistor Q1 is coupled to the input node 332 of the current mirror of the first portion 642, the second terminal 110 of the transistor Q1 is also coupled to the first terminal 114 of the transistor Q1, and a second terminal 120 of the transistor Q2 is coupled to the output 508 of the current mirror for the first portion 642. The first portion 642 further includes the buffer amplifier 430, having an input coupled to the first terminal 114 of the transistor Q1 and an output coupled to the first terminal 124 of the transistor Q2. The first portion 642 further includes at least the master resistor 562 and the slave resistor 564, where the third terminal 112 of the transistor Q1 is coupled to a first terminal of the master resistor 562 and where the third terminal 122 of the transistor Q2 is coupled to a first terminal of the slave resistor 564. The other terminals of the master resistor 562 and the slave resistor 564 of the first portion 642 may be coupled to the ground. In some embodiments, the first portion 642 may further include the capacitor 672, coupled across the master resistor 562. In some embodiments, the first portion 642 may further include an additional master resistor, shown in FIG. 6 as the master resistor 552, and may further include an additional slave resistor, shown in FIG. 6 as the slave resistor 554. The second portion 644 may include a substantially identical set of components as the first portion 642, where the components of the first portion 642 are shown in FIG. 6 to the left of the line 646, while the components of the second portion 644 are shown in FIG. 6 to the right of the line 646. In particular, the second portion 644 includes a current mirror formed by the transistors Q1 and Q2, where the second terminal 110 of the transistor Q1 is coupled to the input node 332 of the current mirror of the first portion 642, the second terminal 110 of the transistor Q1 is also coupled to the first terminal 114 of the transistor Q1, and a second terminal 120 of the transistor Q2 is coupled to the output 508 of the current mirror for the second portion 644. The second portion 644 further includes the buffer amplifier 430, having an input coupled to the first terminal 114 of the transistor Q1 and an output coupled to the first terminal 124 of the transistor Q2. The second portion 644 further includes at least the master resistor 562 and the slave resistor 564, where the third terminal 112 of the transistor Q1 is coupled to a first terminal of the master resistor 562 and where the third terminal 122 of the transistor Q2 is coupled to a first terminal of the slave resistor 564. The other terminals of the master resistor 562 and the slave resistor 564 of the second portion 644 may be coupled to the ground. In some embodiments, the second portion 644 may further include the capacitor 672, coupled across the master resistor 562. In some embodiments, the second portion 644 may further include an additional master resistor, shown in FIG. 6 as the master resistor 552, and may further include an additional slave resistor, shown in FIG. 6 as the slave resistor 554. In the current mirror arrangement 600, the first terminal of the slave resistor 564 of the first portion 642 is coupled to the first terminal of the slave resistor 564 of the second portion 644. Furthermore, in some embodiments of the current mirror arrangement 600, the first terminal of the master resistor 562 of the first portion 642 is coupled to the first terminal of the master resistor 562 of the second portion 644.

Figure 7:
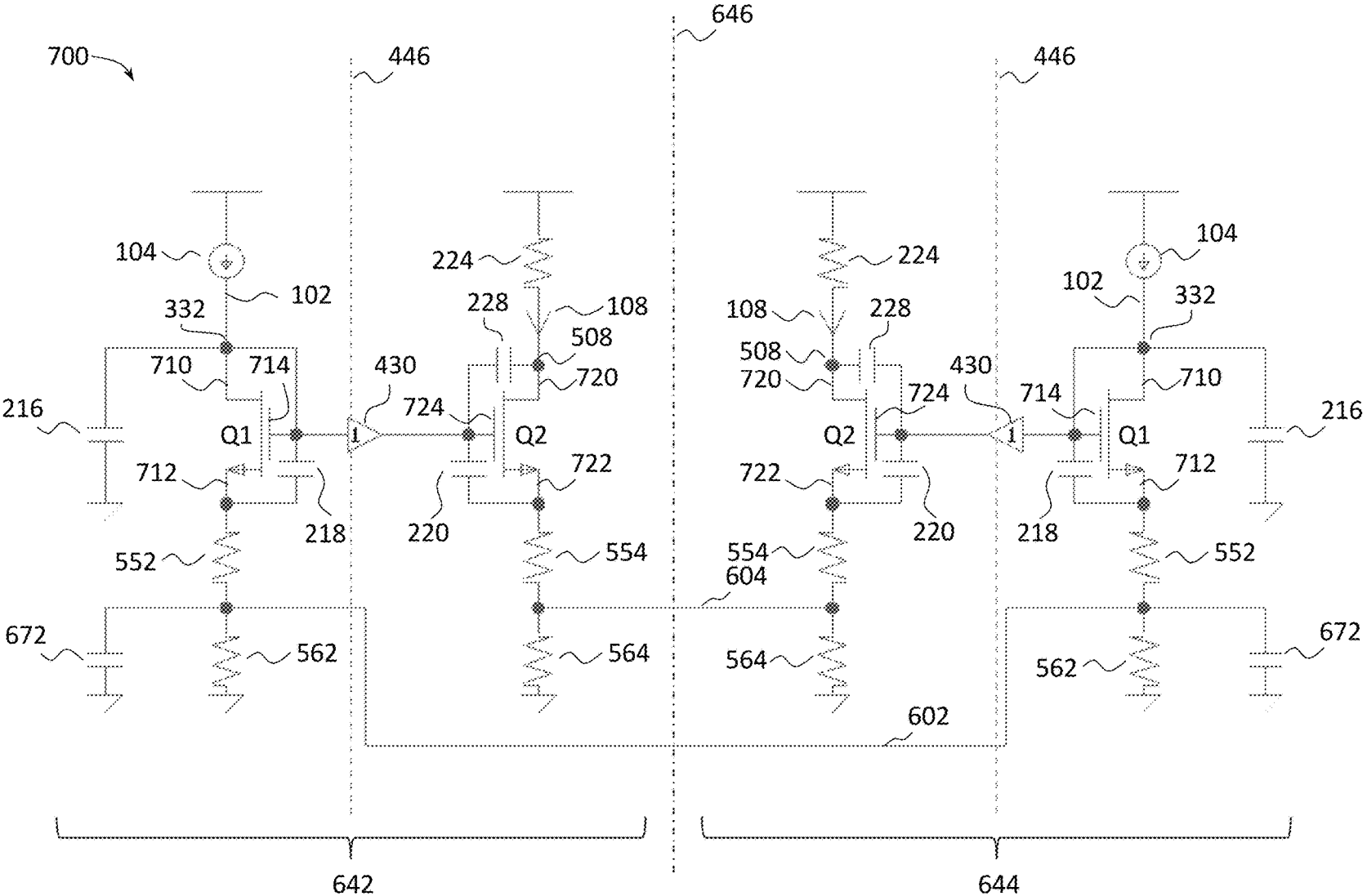
FIG. 7 provides an electric circuit diagram of an N-type metal-oxide-semiconductor (NMOS) implementation of a differential current mirror arrangement with buffers and additional resistors on master and slave sides, according to some embodiments of the disclosure.

While the descriptions provided above refer to the bipolar implementation of the transistors, in other embodiments, a current mirror arrangement may include transistors implemented in MOS. In particular, FIG. 7 provides an electric circuit diagram of a MOS implementation of a current mirror arrangement 700 with a buffer and additional resistors on master and slave sides, according to some embodiments of the disclosure, where transistors Q1 and Q2 in each of the first and second portions 642, 644 may be implemented as NMOS transistors. The current mirror arrangement 700 is substantially analogous to the current mirror arrangement 600 except that each NPN transistor of the current mirror arrangement 600 (i.e., transistors Q1 and Q2 in each of the first and second portions 642, 644) is replaced with an NMOS transistor in the current mirror arrangement 700. In such a configuration, the descriptions provided with reference to FIG. 6 are applicable except that the "first terminals" or "base terminals" of the bipolar transistors become "gate terminals" for the MOS transistors of the current mirror arrangement 700 FIG. 7, the "second terminals" or "collector terminals" of the bipolar transistors become "drain terminals" for the MOS transistors of the current mirror arrangement 700 FIG. 7, and the "third terminals" or "emitter terminals" of the bipolar transistors become "source terminals" for the MOS transistors of the current mirror arrangement 700 FIG. 7. The reference numerals indicating the transistor terminals of the transistors Q1 and Q2 in FIG. 6 (which were not specifically shown in FIG. 6 but were referred to in the description above, i.e., 110, 112, 114, 120, 122, 124) may be replaced, respectively, with reference numerals 710, 712, 714, 720, 722, 724 for the transistors Q1 and Q2 of the current mirror arrangement 700 of FIG. 7.

In the interests of brevity, a detailed description of FIG. 7 is not provided because it's substantially analogous to that of FIG. 6 except for the changes identified above. Instead, only a summary of the current mirror arrangement 700 is provided. The current mirror arrangement 700 is substantially analogous to the current mirror arrangement 600 except that the transistors Q1 and Q2 are now NMOS transistors. Similar to the current mirror arrangement 600, the current mirror arrangement 700 is a differential arrangement, configured to process differential signals. To that end, the arrangement 700 includes two portions which receive different input signals—the first portion 642 is configured to receive the input signal 102 in the form of a first input current $I_{INP}$ that is based on a sum of a bias current IB for the current mirror arrangement 600 and an input signal current $I_{IN}$ (e.g., $I_{INP}$=IB+$I_{IN}$), while the second portion 644 is configured to receive the input signal 102 in the form of a second input current IM that is based on a difference between the bias current IB and the input signal current $I_{IN}$ (e.g., $I_{INM}$=IB−$I_{IN}$). Each of the portions 642, 644 is configured to provide a current at the output that is mirrored with a factor K with respect to the input current received by the portion, i.e., the first portion 642 may generate the output current $I_{OP}$=K*$I_{INP}$ while the second portion 644 may generate the output current $I_{OM}$=K*$I_{INM}$, except where, in contrast to the bipolar implementation, for the MOS implementation of the current mirror arrangement 700, K is a value indicative of a ratio of the aspect ratio of the transistor Q2 to the aspect ratio of the transistor Q1, where an aspect ratio of a MOS transistor is defined as a channel width divided by a channel length. The first portion 642 of the current mirror arrangement 700 includes a current mirror formed by the transistors Q1 and Q2, where the second terminal 710 of the transistor Q1 is coupled to the input node 332 of the current mirror of the first portion 642, the second terminal 710 of the transistor Q1 is also coupled to the first terminal 714 of the transistor Q1, and a second terminal 720 of the transistor Q2 is coupled to the output 508 of the current mirror for the first portion 642. The first portion 642 further includes the buffer amplifier 430, having an input coupled to the first terminal 714 of the transistor Q1 and an output coupled to the first terminal 724 of the transistor Q2. The first portion 642 further includes at least the master resistor 562 and the slave resistor 564, where the third terminal 712 of the transistor Q1 is coupled to a first terminal of the master resistor 562 and where the third terminal 722 of the transistor Q2 is coupled to a first terminal of the slave resistor 564. The other terminals of the master resistor 562 and the slave resistor 564 of the first portion 642 may be coupled to the ground. In some embodiments, the first portion 642 of the current mirror arrangement 700 may further include the capacitor 672, coupled across the master resistor 562. In some embodiments, the first portion 642 of the current mirror arrangement 700 may further include an additional master resistor, shown in FIG. 7 as the master resistor 552, and may further include an additional slave resistor, shown in FIG. 7 as the slave resistor 554. The second portion 644 of the current mirror arrangement 700 may include a substantially identical set of components as the first portion 642, where the components of the first portion 642 of the current mirror arrangement 700 are shown in FIG. 7 to the left of the line 646, while the components of the second portion 644 of the current mirror arrangement 700 are shown in FIG. 7 to the right of the line 646. In particular, the second portion 644 includes a current mirror formed by the transistors Q1 and Q2, where the second terminal 710 of the transistor Q1 is coupled to the input node 332 of the current mirror of the first portion 642, the second terminal 710 of the transistor Q1 is also coupled to the first terminal 714 of the transistor Q1, and the second terminal 720 of the transistor Q2 is coupled to the output 508 of the current mirror for the second portion 644. The second portion 644 further includes the buffer amplifier 430, having an input coupled to the first terminal 714 of the transistor Q1 and an output coupled to the first terminal 724 of the transistor Q2. The second portion 644 of the current mirror arrangement 700 further includes at least the master resistor 562 and the slave resistor 564, where the third terminal 712 of the transistor Q1 is coupled to a first terminal of the master resistor 562 and where the third terminal 722 of the transistor Q2 is coupled to a first terminal of the slave resistor 564. The other terminals of the master resistor 562 and the slave resistor 564 of the second portion 644 of the current mirror arrangement 700 may be coupled to the ground. In some embodiments, the second portion 644 of the current mirror arrangement 700 may further include the capacitor 672, coupled across the master resistor 562. In some embodiments, the second portion 644 of the current mirror arrangement 700 may further include an additional master resistor, shown in FIG. 7 as the master resistor 552, and may further include an additional slave resistor, shown in FIG. 7 as the slave resistor 554. In the current mirror arrangement 700, the first terminal of the slave resistor 564 of the first portion 642 is coupled to the first terminal of the slave resistor 564 of the second portion 644. Furthermore, in some embodiments of the current mirror arrangement 700, the first terminal of the master resistor 562 of the first portion 642 is coupled to the first terminal of the master resistor 562 of the second portion 644. Discussions related to the relative sizes of the additional resistors and capacitors 672, provided with reference to the current mirror arrangement 600 of FIG. 6 are applicable to the current mirror arrangement 700 of FIG. 7 and, therefore, in the interests of brevity, are not repeated.

Figure 8:
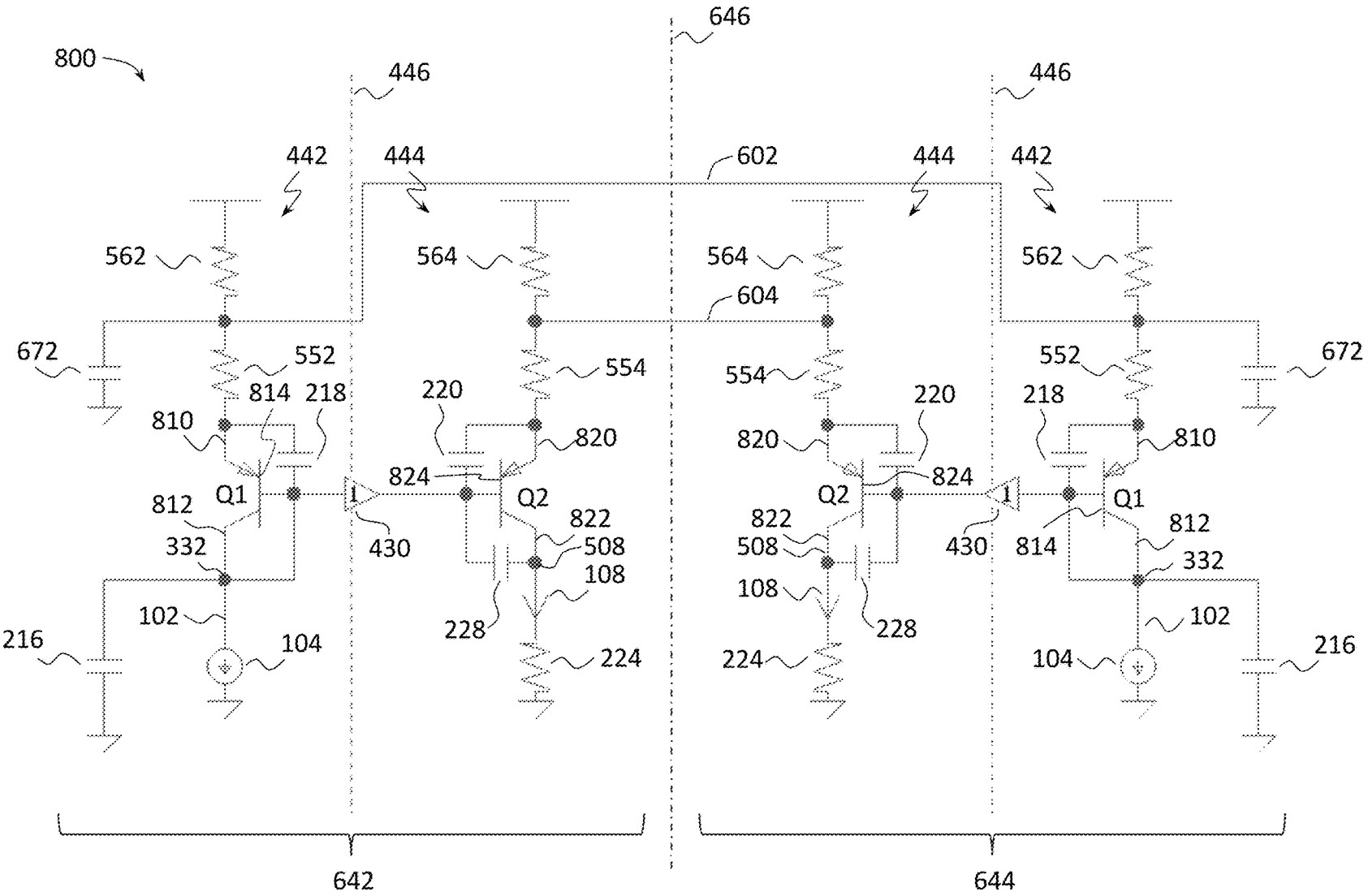
FIG. 8 provides an electric circuit diagram of a PNP implementation of a differential current mirror arrangement with buffers and additional resistors on master and slave sides, according to some embodiments of the disclosure.

Further variations to the current mirror arrangements with buffers and additional resistors on master and slave sides, enabling reduced sensitivity to buffer offsets, are possible. In particular, while the descriptions provided above refer to the NPN and NMOS implementation of the transistors Q1 and Q2 (i.e., with the transistors Q1 and Q2 being implemented as N-type transistors), in other embodiments, the transistors Q1 and Q2 described above may be implemented as PNP or PMOS transistors (i.e., as P-type transistors). FIG. 8 provides an electric circuit diagram of a PNP implementation of a differential current mirror arrangement 800 with buffers and additional resistors on master and slave sides, according to some embodiments of the disclosure where transistors Q1 and Q2 may be implemented as PNP transistors. The current mirror arrangement 800 is substantially analogous to the current mirror arrangement 600 except that each NPN transistor of the current mirror arrangement 600 (i.e., two transistors Q1 and Q2 in each of the first portion 642 and the second portion 644) is replaced with a PNP transistor in the current mirror arrangement 800. In such a configuration, the descriptions provided with reference to FIG. 6 are applicable to the current mirror arrangement 800 except that NPN and PNP transistors are swapped, and supply and current directions are reversed. The designations such as "first/base terminals," "second/collector terminals," and "third/emitter terminals" remain the same. The reference numerals indicating the transistor terminals of the transistors Q1 and Q2 in FIG. 6 (which were not specifically shown in FIG. 6 but were referred to in the description above, i.e., 110, 112, 114, 120, 122, 124) may be replaced, respectively, with reference numerals 810, 812, 814, 820, 822, 824 for the transistors Q1 and Q2 of the current mirror arrangement 800 of FIG. 8.

In the interests of brevity, a detailed description of FIG. 8 is not provided because it's substantially analogous to that of FIG. 6 except for the changes identified above. Instead, only a summary of the current mirror arrangement 800 is provided. The current mirror arrangement 800 is substantially analogous to the current mirror arrangement 600 except that the transistors Q1 and Q2 are now PNP transistors and supply and current directions are reversed. Similar to the current mirror arrangement 600, the current mirror arrangement 800 is a differential arrangement, configured to process differential signals. To that end, the arrangement 800 includes two portions which receive different input signals—the first portion 642 is configured to receive the input signal 102 in the form of a first input current $I_{IN}$, that is based on a sum of a bias current IB for the current mirror arrangement 600 and an input signal current $I_{INP}$ (e.g., $I_{INP}$=IB+$I_{IN}$), while the second portion 644 is configured to receive the input signal 102 in the form of a second input current $I_{INM}$ that is based on a difference between the bias current IB and the input signal current $I_{IN}$ (e.g., $I_{INM}$=IB−$I_{IN}$). Each of the portions 642, 644 is configured to provide a current at the output that is mirrored with a factor K with respect to the input current received by the portion, i.e., the first portion 642 may generate the output current $I_{OP}$=K*$I_{INP}$ while the second portion 644 may generate the output current $I_{OM}$=K*$I_{INM}$, where K is a number greater than 0 (which value may, but does not have to be, an integer), indicative of a ratio of an area of the emitter of the transistor Q2 to an area of the emitter of the transistor Q1. The first portion 642 of the current mirror arrangement 800 includes a current mirror formed by the transistors Q1 and Q2, where the second terminal 810 of the transistor Q1 is coupled to the input node 332 of the current mirror of the first portion 642, the second terminal 810 of the transistor Q1 is also coupled to the first terminal 814 of the transistor Q1, and a second terminal 820 of the transistor Q2 is coupled to the output 508 of the current mirror for the first portion 642. The first portion 642 further includes the buffer amplifier 430, having an input coupled to the first terminal 814 of the transistor Q1 and an output coupled to the first terminal 824 of the transistor Q2. The first portion 642 further includes at least the master resistor 562 and the slave resistor 564, where the third terminal 812 of the transistor Q1 is coupled to a first terminal of the master resistor 562 and where the third terminal 822 of the transistor Q2 is coupled to a first terminal of the slave resistor 564. The other terminals of the master resistor 562 and the slave resistor 564 of the first portion 642 may be coupled to the ground. In some embodiments, the first portion 642 of the current mirror arrangement 800 may further include the capacitor 672, coupled across the master resistor 562. In some embodiments, the first portion 642 of the current mirror arrangement 800 may further include an additional master resistor, shown in FIG. 8 as the master resistor 552, and may further include an additional slave resistor, shown in FIG. 8 as the slave resistor 554. The second portion 644 of the current mirror arrangement 800 may include a substantially identical set of components as the first portion 642, where the components of the first portion 642 of the current mirror arrangement 800 are shown in FIG. 8 to the left of the line 646, while the components of the second portion 644 of the current mirror arrangement 800 are shown in FIG. 8 to the right of the line 646. In particular, the second portion 644 includes a current mirror formed by the transistors Q1 and Q2, where the second terminal 810 of the transistor Q1 is coupled to the input node 332 of the current mirror of the first portion 642, the second terminal 810 of the transistor Q1 is also coupled to the first terminal 814 of the transistor Q1, and the second terminal 820 of the transistor Q2 is coupled to the output 508 of the current mirror for the second portion 644. The second portion 644 further includes the buffer amplifier 430, having an input coupled to the first terminal 814 of the transistor Q1 and an output coupled to the first terminal 824 of the transistor Q2. The second portion 644 of the current mirror arrangement 800 further includes at least the master resistor 562 and the slave resistor 564, where the third terminal 812 of the transistor Q1 is coupled to a first terminal of the master resistor 562 and where the third terminal 822 of the transistor Q2 is coupled to a first terminal of the slave resistor 564. The other terminals of the master resistor 562 and the slave resistor 564 of the second portion 644 of the current mirror arrangement 800 may be coupled to the ground. In some embodiments, the second portion 644 of the current mirror arrangement 800 may further include the capacitor 672, coupled across the master resistor 562. In some embodiments, the second portion 644 of the current mirror arrangement 800 may further include an additional master resistor, shown in FIG. 8 as the master resistor 552, and may further include an additional slave resistor, shown in FIG. 8 as the slave resistor 554. In the current mirror arrangement 800, the first terminal of the slave resistor 564 of the first portion 642 is coupled to the first terminal of the slave resistor 564 of the second portion 644. Furthermore, in some embodiments of the current mirror arrangement 800, the first terminal of the master resistor 562 of the first portion 642 is coupled to the first terminal of the master resistor 562 of the second portion 644. Discussions related to the relative sizes of the additional resistors and capacitors 672, provided with reference to the current mirror arrangement 600 of FIG. 6 are applicable to the current mirror arrangement 800 of FIG. 8 and, therefore, in the interests of brevity, are not repeated.

Figure 9:
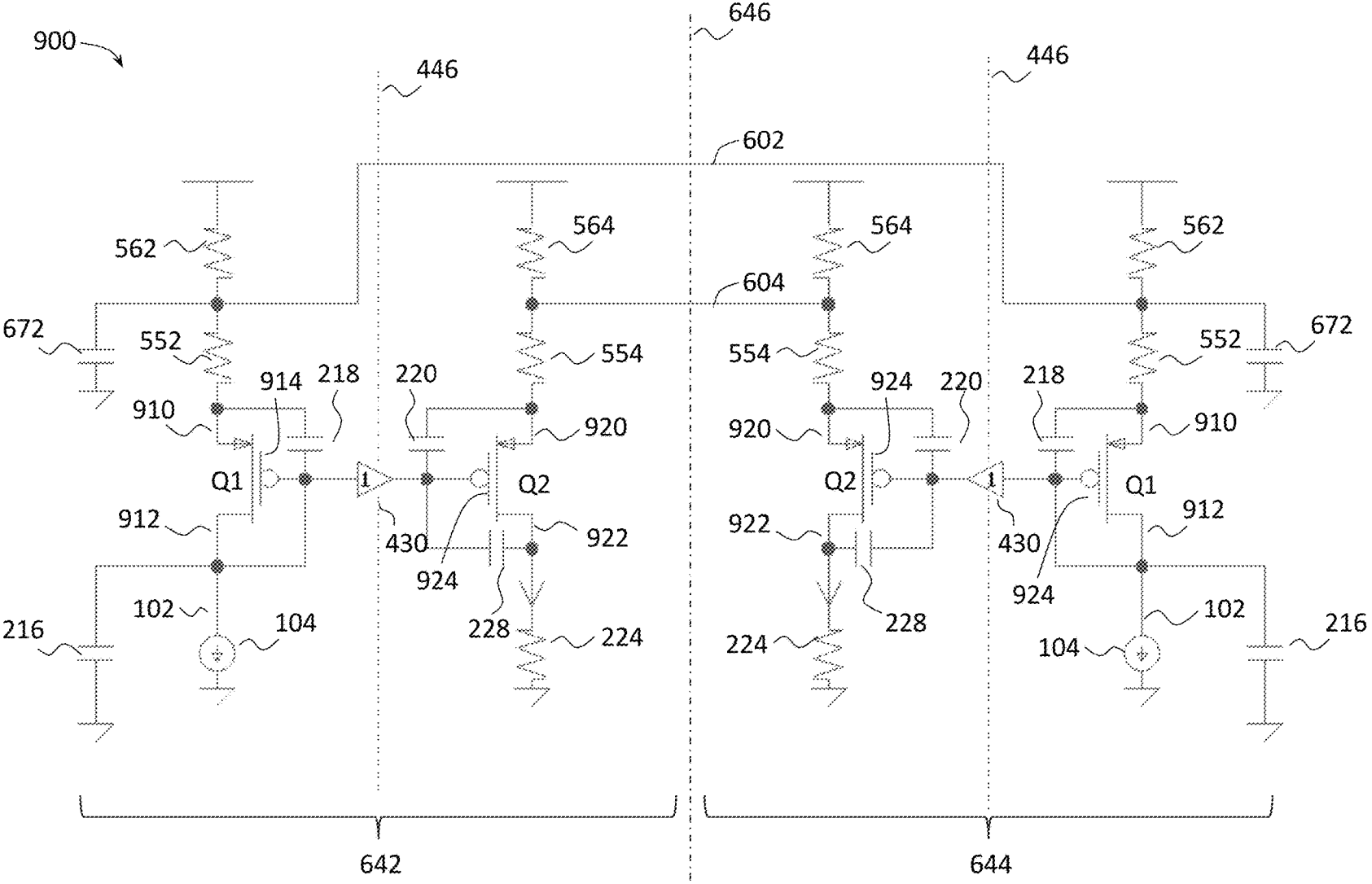
FIG. 9 provides an electric circuit diagram of a P-type metal-oxide-semiconductor (PMOS) implementation of a differential current mirror arrangement with buffers and additional resistors on master and slave sides, according to some embodiments of the disclosure.

In yet another embodiment, the PNP transistors Q1 and Q2 of the current mirror arrangement 800 may be replaced with PMOS transistors, as shown with a current mirror arrangement 900 of FIG. 9. In particular, FIG. 9 provides an electric circuit diagram of a CMOS implementation of a current mirror arrangement 900 with a buffer and additional resistors on master and slave sides, according to some embodiments of the disclosure, where transistors Q1 and Q2 in each of the first and second portions 642, 644 may be implemented as PMOS transistors. The current mirror arrangement 900 is substantially analogous to the current mirror arrangement 800 except that each PNP transistor of the current mirror arrangement 800 (i.e., transistors Q1 and Q2 in each of the first and second portions 642, 644) is replaced with a PMOS transistor in the current mirror arrangement 900. In such a configuration, the descriptions provided with reference to FIG. 6 are applicable except that the "first terminals" or "base terminals" of the bipolar transistors become "gate terminals" for the MOS transistors of the current mirror arrangement 900 FIG. 9, the "second terminals" or "collector terminals" of the bipolar transistors become "drain terminals" for the CMOS transistors of the current mirror arrangement 900 FIG. 9, and the "third terminals" or "emitter terminals" of the bipolar transistors become "source terminals" for the MOS transistors of the current mirror arrangement 900 FIG. 9. The reference numerals indicating the transistor terminals of the transistors Q1 and Q2 in FIG. 6 (which were not specifically shown in FIG. 6 but were referred to in the description above, i.e., 110, 112, 114, 120, 122, 124) may be replaced, respectively, with reference numerals 910, 912, 914, 920, 922, 924 for the transistors Q1 and Q2 of the current mirror arrangement 900 of FIG. 9.

In the interests of brevity, a detailed description of FIG. 9 is not provided because it's substantially analogous to that of FIG. 6 except for the changes identified above. Instead, only a summary of the current mirror arrangement 900 is provided. The current mirror arrangement 900 is substantially analogous to the current mirror arrangement 800 except that the transistors Q1 and Q2 are now PMOS transistors. Similar to the current mirror arrangement 800, the current mirror arrangement 900 is a differential arrangement, configured to process differential signals. To that end, the arrangement 900 includes two portions which receive different input signals—the first portion 642 is configured to receive the input signal 102 in the form of a first input current $I_{INP}$ that is based on a sum of a bias current IB for the current mirror arrangement 600 and an input signal current $I_{IN}$ (e.g., $I_{INP}$=IB+$I_{IN}$), while the second portion 644 is configured to receive the input signal 102 in the form of a second input current $I_{INM}$ that is based on a difference between the bias current IB and the input signal current $I_{IN}$ (e.g., $I_{INM}$=1B−$I_{IN}$). Each of the portions 642, 644 is configured to provide a current at the output that is mirrored with a factor K with respect to the input current received by the portion, i.e., the first portion 642 may generate the output current $I_{OP}$=K*$I_{INP}$ while the second portion 644 may generate the output current $I_{OM}$=K*$I_{INM}$, except where, in contrast to the bipolar implementation, for the CMOS implementation of the current mirror arrangement 900, K is a value indicative of a ratio of the aspect ratio of the transistor Q2 to the aspect ratio of the transistor Q1, where an aspect ratio of a MOS transistor is defined as a channel width divided by a channel length. The first portion 642 of the current mirror arrangement 900 includes a current mirror formed by the transistors Q1 and Q2, where the second terminal 910 of the transistor Q1 is coupled to the input node 332 of the current mirror of the first portion 642, the second terminal 910 of the transistor Q1 is also coupled to the first terminal 914 of the transistor Q1, and a second terminal 920 of the transistor Q2 is coupled to the output 508 of the current mirror for the first portion 642. The first portion 642 further includes the buffer amplifier 430, having an input coupled to the first terminal 914 of the transistor Q1 and an output coupled to the first terminal 924 of the transistor Q2. The first portion 642 further includes at least the master resistor 562 and the slave resistor 564, where the third terminal 912 of the transistor Q1 is coupled to a first terminal of the master resistor 562 and where the third terminal 922 of the transistor Q2 is coupled to a first terminal of the slave resistor 564. The other terminals of the master resistor 562 and the slave resistor 564 of the first portion 642 may be coupled to the ground. In some embodiments, the first portion 642 of the current mirror arrangement 900 may further include the capacitor 672, coupled across the master resistor 562. In some embodiments, the first portion 642 of the current mirror arrangement 900 may further include an additional master resistor, shown in FIG. 9 as the master resistor 552, and may further include an additional slave resistor, shown in FIG. 9 as the slave resistor 554. The second portion 644 of the current mirror arrangement 900 may include a substantially identical set of components as the first portion 642, where the components of the first portion 642 of the current mirror arrangement 900 are shown in FIG. 9 to the left of the line 646, while the components of the second portion 644 of the current mirror arrangement 900 are shown in FIG. 9 to the right of the line 646. In particular, the second portion 644 includes a current mirror formed by the transistors Q1 and Q2, where the second terminal 910 of the transistor Q1 is coupled to the input node 332 of the current mirror of the first portion 642, the second terminal 910 of the transistor Q1 is also coupled to the first terminal 914 of the transistor Q1, and the second terminal 920 of the transistor Q2 is coupled to the output 508 of the current mirror for the second portion 644. The second portion 644 further includes the buffer amplifier 430, having an input coupled to the first terminal 914 of the transistor Q1 and an output coupled to the first terminal 924 of the transistor Q2. The second portion 644 of the current mirror arrangement 900 further includes at least the master resistor 562 and the slave resistor 564, where the third terminal 912 of the transistor Q1 is coupled to a first terminal of the master resistor 562 and where the third terminal 922 of the transistor Q2 is coupled to a first terminal of the slave resistor 564. The other terminals of the master resistor 562 and the slave resistor 564 of the second portion 644 of the current mirror arrangement 900 may be coupled to the ground. In some embodiments, the second portion 644 of the current mirror arrangement 900 may further include the capacitor 672, coupled across the master resistor 562. In some embodiments, the second portion 644 of the current mirror arrangement 900 may further include an additional master resistor, shown in FIG. 9 as the master resistor 552, and may further include an additional slave resistor, shown in FIG. 9 as the slave resistor 554. In the current mirror arrangement 900, the first terminal of the slave resistor 564 of the first portion 642 is coupled to the first terminal of the slave resistor 564 of the second portion 644. Furthermore, in some embodiments of the current mirror arrangement 900, the first terminal of the master resistor 562 of the first portion 642 is coupled to the first terminal of the master resistor 562 of the second portion 644. Discussions related to the relative sizes of the additional resistors and capacitors 672, provided with reference to the current mirror arrangement 600 of FIG. 6 are applicable to the current mirror arrangement 900 of FIG. 9 and, therefore, in the interests of brevity, are not repeated.

Still further variations to the current mirror arrangements with buffers and additional resistors on master and slave slides are possible. For example, in some embodiments, a current mirror arrangement with N-type transistors Q1 and Q2 (e.g., a current mirror arrangement similar to the current mirror arrangements 500, 600, or 700) may include any combination of NPN and NMOS transistors (i.e., one or more of the transistors Q1 and Q2 may be implemented as NPN transistors, while one or more of the transistors Q1 and Q2 may be implemented NMOS transistors). Similarly, in some embodiments, a current mirror arrangement with P-type transistors Q1 and Q2 (e.g., a current mirror arrangement similar to the current mirror arrangements 800 or 900) may include any combination of PNP and PMOS transistors (i.e., one or more of the transistors Q1 and Q2 may be implemented as PNP transistors, while one or more of the transistors Q1 and Q2 may be implemented PMOS transistors).

Figure 10:
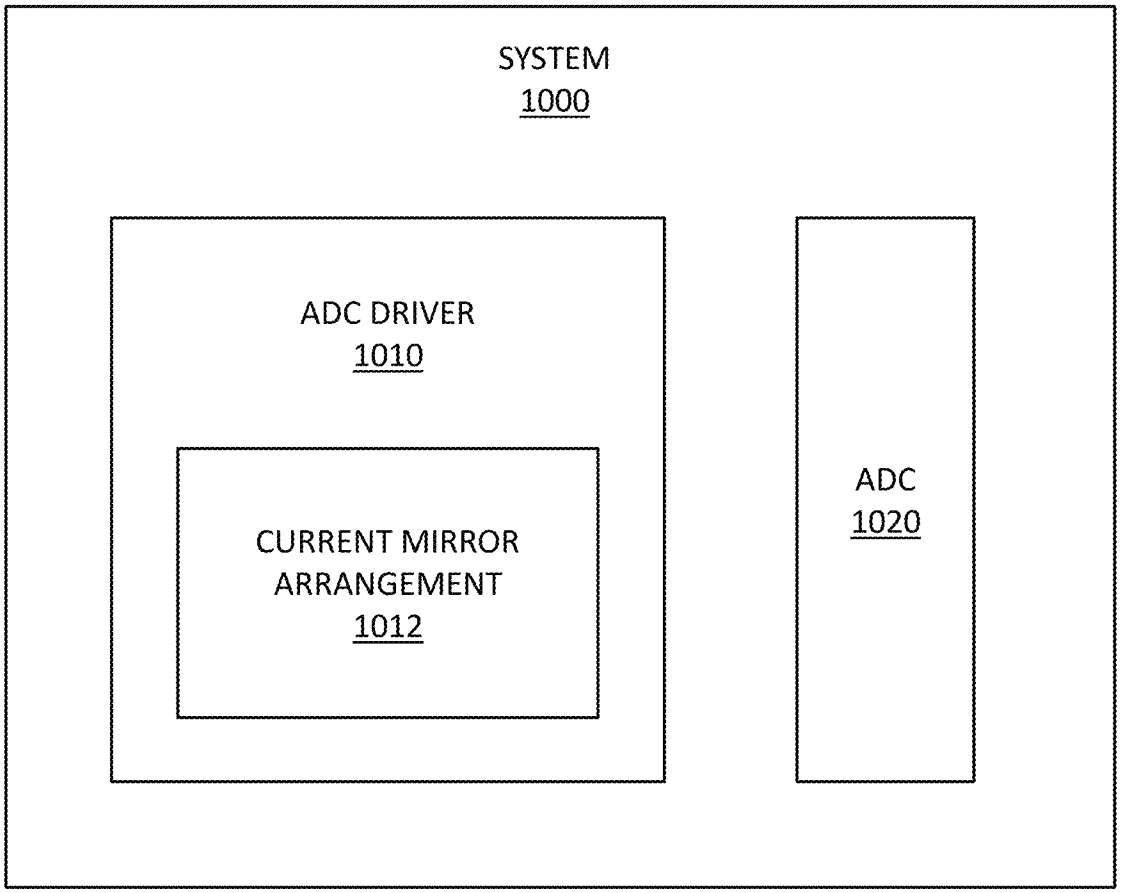
FIG. 10 provides a schematic illustration of a system implementing a current mirror arrangement with one or more buffers and with additional resistors on master and slave sides, according to some embodiments of the disclosure.

Example Systems with Current Mirror Arrangements with Buffers and Additional Resistors Various embodiments of current mirror arrangements with reduced sensitivity to buffer offsets as described above may be implemented in any kind of system where current mirroring may be used. Such current mirror arrangements may be particularly useful in systems where current mirrors having both high linearity and wide signal bandwidth are needed. One example of such a system is shown in FIG. 10, providing a schematic illustration of a system 1000 implementing a current mirror arrangement 1012, according to some embodiments of the disclosure. As shown in FIG. 10, the system 1000 may include an ADC driver 1010 and an ADC 1020. The ADC driver 1010 may be used to provide drive signals to drive the ADC 1020 so that the ADC 1020 can translate analog electrical signals to digital form, e.g., for data processing purposes. In particular, the ADC driver 1010 may include the current mirror arrangement 1012 which can be implemented according to any embodiments of current mirror arrangements with one or more buffers and with additional resistors on master and slave sides, described above. For example, the current mirror arrangement 1012 may be implemented as the current mirror arrangement 500, 600, 700, 800, or 900, or as any further embodiments of these current mirror arrangements, as described above. The ADC driver 1010 may then generate drive signals based on the output signal(s) generated by the current mirror arrangement 1012. In various embodiments, the drive signals generated by the ADC driver 1010 may be used to drive a single or dual differential input of the ADC 1020.

In various embodiments, the drive signal generated by the ADC driver 1010 may realize/implement functions such as buffering, amplitude scaling, single-ended-to-differential and differential-to-single-ended conversion, common-mode offset adjustment, and filtering. In other words, the ADC driver 1010 may act as a signal conditioning element in a data conversion stage and may be a key factor in enabling the ADC 1020 to achieve its desired performance. The ADC 1020 may be any type of ADC, such as, but not limited to, a successive approximation register (SAR) converter, a pipeline converter, a flash converter, or a sigma-delta converter.

The system 1000 shown in FIG. 10 provides just one non-limiting example where current mirror arrangements as described herein may be used and various teachings related to current mirror arrangements with reduced sensitivity to buffer offsets as described herein are applicable to a large variety of other systems. In some scenarios, various embodiments of current mirror arrangements with reduced sensitivity to buffer offsets by implementing one or more buffers and with additional resistors on master and slave sides as described herein can be used in automotive systems, safety-critical industrial applications, medical systems, scientific instrumentation, wireless and wired communications, radar, industrial process control, audio and video equipment, current sensing, instrumentation (which can be highly precise), and various digital-processing-based systems. In other scenarios, various embodiments of current mirror arrangements with reduced sensitivity to buffer offsets as described herein can be used in the industrial markets that include process control systems that help drive productivity, energy efficiency, and reliability. In yet further scenarios, various embodiments of current mirror arrangements with reduced sensitivity to buffer offsets may be used in consumer applications.

In one example embodiment, any number of electrical circuits of the present drawings may be implemented on a board of an associated electronic device. The board can be a general circuit board that can hold various components of the internal electronic system of the electronic device and, further, provide connectors for other peripherals. More specifically, the board can provide the electrical connections by which the other components of the system can communicate electrically. Any suitable processors (inclusive of digital signal processors, microprocessors, supporting chipsets, etc.), computer-readable non-transitory memory elements, etc. can be suitably coupled to the board based on particular configuration needs, processing demands, computer designs, etc. Other components such as external storage, additional sensors, controllers for audio/video display, and peripheral devices may be attached to the board as plug-in cards, via cables, or integrated into the board itself.

In another example embodiment, the electrical circuits of the present drawings may be implemented as stand-alone modules (e.g., a device with associated components and circuitry configured to perform a specific application or function) or implemented as plug-in modules into application specific hardware of electronic devices. Note that particular embodiments of the present disclosure related to current mirror arrangements with reduced sensitivity to buffer offsets may be readily included in a system on chip (SOC) package, either in part, or in whole. An SOC represents an IC that integrates components of a computer or other electronic system into a single chip. It may contain digital, analog, mixed-signal, and often radio frequency functions: all of which may be provided on a single chip substrate. Other embodiments may include a multi-chip-module (MCM), with a plurality of separate ICs located within a single electronic package and configured to interact closely with each other through the electronic package. In various other embodiments, the functionalities of current mirror arrangements with reduced sensitivity to buffer offsets, proposed herein, may be implemented in one or more silicon cores in Application Specific Integrated Circuits (ASICs), Field Programmable Gate Arrays (FPGAs), and other semiconductor chips.

Select Examples

The following paragraphs provide examples of various ones of the embodiments disclosed herein.

Example 1 provides a current mirror arrangement that includes a first portion and a second portion. Each of the portions includes a current mirror, configured to receive a respective (i.e., different) input current at an input. For example, the first portion may receive an input signal in the form of a first input current $I_{INP}$, that is based on a sum of a bias current IB for the current mirror arrangement and an input signal current $I_{IN}$ (e.g., $I_{INP}$=IB+$I_{IN}$), while the second portion may receive the input signal in the form of a second input current $I_{INM}$ that is based on a difference between the bias current IB and the input signal current $I_{IN}$ (e.g., $I_{INM}$=IB−$I_{IN}$). Thus, the first and second portions may be portions of a differential current mirror arrangement) and provide a respective (i.e., different) output current at an output, where a ratio of the output current to the input current is equal to K, where K is a number greater than 0 (which value may, but does not have to be, an integer). For example, the output current of the first portion may be $I_{OP}$=K*$I_{INP}$ and the output current of the second portion may be $I_{OM}$=K*$I_{INM}$. In each of the portions, the current mirror includes a transistor 1 and a transistor Q2, where a second terminal of the transistor Q1 is coupled to the input of the current mirror (i.e., coupled to the input current for the portion), the second terminal of the transistor Q1 is also coupled to the first terminal of the transistor Q1, and a second terminal of the transistor Q2 is coupled to the output of the current mirror for the portion (i.e., coupled to the output current for the portion). Each of the portions further includes a buffer amplifier, having an input coupled to a first terminal of the transistor Q1 and an output coupled to a first terminal of the transistor Q2. Each of the portions further includes a master resistor (e.g., a master resistor 562) and a slave resistor (e.g., a slave resistor 564), where a third terminal of the transistor Q1 is coupled to a first terminal of the master resistor and where a third terminal of the transistor Q2 is coupled to a first terminal of the slave resistor. With such first and second portions, the first terminal of the slave resistor of the first portion may be coupled to the first terminal of the slave resistor of the second portion.

Example 2 provides the current mirror arrangement according to example 1, where a second terminal of each of the slave resistor of the first portion and the slave resistor of the second portion is coupled to a ground potential.

Example 3 provides the current mirror arrangement according to example 2, where each of the first portion and the second portion further includes a capacitor, and for each of the first portion and the second portion, a first terminal of the capacitor is coupled to the first terminal of the master resistor and a second terminal of the capacitor is coupled to the ground potential.

Example 4 provides the current mirror arrangement according to any one of the preceding examples, where a first terminal of the master resistor of the first portion is coupled to a first terminal of the master resistor of the second portion.

Example 5 provides the current mirror arrangement according to any one of the preceding examples, where a resistance of the slave resistor is smaller than a resistance of the master resistor, e.g., about K times smaller, when a current gain K of the current mirror is greater than 1, and where the resistance of the master resistor is smaller than the resistance of the slave resistor, e.g., about K times smaller, when the current gain K of the current mirror is less than 1.

Example 6 provides the current mirror arrangement according to any one of the preceding examples, where each of the first portion and the second portion further includes an additional master resistor (e.g., a master resistor 552), and the third terminal of the transistor Q1 being coupled to the first terminal of the master resistor includes the third terminal of the transistor Q1 being coupled to a first terminal of the additional master resistor and a second terminal of the additional master resistor being coupled to the first terminal of the master resistor.

Example 7 provides the current mirror arrangement according to example 6, where, for each of the first portion and the second portion, a resistance of the additional master resistor is smaller than a resistance of the master resistor.

From design perspective, in some embodiments, the procedure for selecting resistance values for these two master resistors may be is as follows. The sum of the master resistor and the additional master resistor values may be determined with respect to maximum allowed voltage drop between the node 332 and ground or available headroom. The value of additional master resistor may be chosen to be minimum, which may help achieving relatively homogenous emitter current distribution for Q1 and Q2. The value of the other master resistor may be chosen so that the sum of the master resistor and the additional master resistor values may be as determined above.

Example 8 provides the current mirror arrangement according to any one of the preceding examples, where each of the first portion and the second portion further includes an additional slave resistor (e.g., a slave resistor 554), and the third terminal of the transistor Q2 being coupled to the first terminal of the slave resistor includes the third terminal of the transistor Q2 being coupled to a first terminal of the additional slave resistor and a second terminal of the additional slave resistor being coupled to the first terminal of the slave resistor.

Example 9 provides the current mirror arrangement according to example 8, where a resistance of the additional slave resistor is smaller than a resistance of the additional master resistor, e.g., about K times smaller, when a current gain K of the current mirror is greater than 1, and where the resistance of the additional master resistor is smaller than the resistance of the additional slave resistor, e.g., about K times smaller, when the current gain K of the current mirror is less than 1.

Example 10 provides the current mirror arrangement according to any one of examples 1-9, where each of the transistor Q1 and the transistor Q2 is a bipolar transistor, and for each of the transistor Q1 and the transistor Q2, the first terminal is a base terminal, the second terminal is a collector terminal, and the third terminal is an emitter terminal.

Example 11 provides the current mirror arrangement according to any one of examples 1-9, where each of the transistor Q1 and the transistor Q2 is a field-effect transistor, and for each of the transistor Q1 and the transistor Q2, the first terminal is a gate terminal, the second terminal is a drain terminal, and the third terminal is a source terminal.

Example 12 provides a current mirror arrangement that includes a current mirror, configured to receive an input current ($I_{IN}$) at an input and provide a mirrored current (IO) at an output, where IO=K*$I_{IN}$, where K is a number greater than 0 (which value may, but does not have to be, an integer), the current mirror including a transistor Q1 and a transistor Q2. The current mirror arrangement further includes a buffer amplifier, having an input coupled to a first terminal of the transistor Q1 and an output coupled to a first terminal of the transistor Q2; a master set, including a first master resistor and a second master resistor; and a slave set, including a first slave resistor and a second slave resistor. In such an arrangement, a second terminal of the transistor Q1 is coupled to the input of the current mirror (i.e., coupled to the input current $I_{IN}$), the second terminal of the transistor Q1 is also coupled to the first terminal of the transistor Q1), a second terminal of the transistor Q2 is coupled to the output of the current mirror (i.e., coupled to the output current 10), a third terminal of the transistor Q1 is coupled to a first terminal of the first master resistor, a third terminal of the transistor Q2 is coupled to a first terminal of the first slave resistor, the second master resistor includes a first terminal coupled to a second terminal of the first master resistor, and further includes a second terminal coupled to a ground potential (thus, the second master resistor is in electrical series with the first master resistor), and the second slave resistor includes a first terminal coupled to a second terminal of the first slave resistor, and further includes a second terminal coupled to the ground potential (thus, the second slave resistor is in electrical series with the first slave resistor).

Example 13 provides the current mirror arrangement according to example 12, where the master set further includes a master capacitor, the slave set further includes a slave capacitor, the master capacitor includes a first terminal coupled to the second terminal of the first master resistor, and further includes a second terminal coupled to the ground potential, and the slave capacitor includes a first terminal coupled to the second terminal of the first slave resistor, and further includes a second terminal coupled to the ground potential.

Example 14 provides the current mirror arrangement according to example 13, where a capacitance of the slave capacitor is larger, e.g. K times larger, than a capacitance of the master capacitor when a current gain K of the current mirror is greater than 1, and wherein the capacitance of the master capacitor is larger, e.g. K times larger, than the capacitance of the slave capacitor when the current gain K of the current mirror is less than 1.

Example 15 provides the current mirror arrangement according to any one of examples 12-14, where a resistance of the first master resistor is smaller than a resistance of the second master resistor.

From design perspective, in some embodiments, the procedure for selecting resistance values for the first and second master resistors may be is as follows. The sum of first and second master resistor values may be determined with respect to maximum allowed voltage drop between node N1 (FIG. 5) and ground or available headroom. The value of first master resistor may be chosen to be minimum, which may help achieving relatively homogenous emitter current distribution for Q1 and Q2.

Example 16 provides the current mirror arrangement according to any one of examples 12-15, where a resistance of the first slave resistor is smaller than a resistance of the first master resistor, e.g., about K times smaller, when a current gain K of the current mirror is greater than 1, and wherein the resistance of the first master resistor is smaller than the resistance of the first slave resistor, e.g., about K times smaller, when the current gain K of the current mirror is less than 1.

Example 17 provides the current mirror arrangement according to any one of examples 12-16, where a resistance of the second slave resistor is smaller than a resistance of the second master resistor, e.g., about K times smaller, when a current gain K of the current mirror is greater than 1, and wherein the resistance of the second master resistor is smaller than the resistance of the second slave resistor, e.g., about K times smaller, when the current gain K of the current mirror is less than 1.

Example 18 provides the current mirror arrangement according to any one of examples 12-17, where the current mirror arrangement is a differential current mirror arrangement that includes a first signal path and a second signal path. The first signal path includes the current mirror, the buffer amplifier, the master set, and the slave set, where the input current received at the input of the current mirror of example 1 is a first input current ($I_{IN}$), the first input current being based on a sum of a bias signal (IB) (e.g., bias current) for biasing the differential current mirror arrangement and an input signal ($I_{IN}$), e.g., $I_{INP}$=IB+$I_{IN}$. The second signal path includes a further current mirror, including a further transistor Q1 and a further transistor Q2, the further current mirror configured to receive a second input current ($I_{INM}$) at a further input and provide a mirrored current (IOM) of the second input current at a further output, where IOM=K*$I_{INM}$ and where the second input current is based on a difference between the bias signal and the input signal (e.g., NM=B−$I_{IN}$). The second signal path further includes a further buffer amplifier, having an input coupled to a first terminal of the further transistor Q1 and an output coupled to a first terminal of the further transistor Q2; a further master set, including a further first master resistor and a further second master resistor; and a further slave set, including a further first slave resistor and a further second slave resistor. In such an arrangement, a second terminal of the further transistor Q1 is coupled to the further input of the current mirror (i.e., coupled to the input current $I_{INM}$), the second terminal of the further transistor Q1 is also coupled to the first terminal of the further transistor Q1), a second terminal of the further transistor Q2 is coupled to the further output of the further current mirror (i.e., coupled to the output current IOM), a third terminal of the further transistor Q1 is coupled to a first terminal of the further first master resistor, a third terminal of the further transistor Q2 is coupled to a first terminal of the further first slave resistor, the further second master resistor includes a first terminal coupled to a second terminal of the further first master resistor and further includes a second terminal coupled to the ground potential (thus, the further second master resistor is in electrical series with the further first master resistor), and the further second slave resistor includes a first terminal coupled to a second terminal of the further first slave resistor and further includes a second terminal coupled to the ground potential (thus, the further second slave resistor is in electrical series with the further first slave resistor).

Example 19 provides the current mirror arrangement according to example 18, where each of the second terminal of the first slave resistor and the first terminal of the second slave resistor is coupled to each of the second terminal of the further first slave resistor and the first terminal of the further second slave resistor.

Example 20 provides the current mirror arrangement according to examples 18 or 19, where each of the second terminal of the first master resistor and the first terminal of the second master resistor is coupled to each of the second terminal of the further first master resistor and the first terminal of the further second master resistor.

Example 21 provides the current mirror arrangement according to example 20, where the master set further includes a master capacitor, the further master set further includes a further master capacitor, the master capacitor includes a first terminal coupled to the second terminal of the first master resistor, and further includes a second terminal coupled to the ground potential, and the further master capacitor includes a first terminal coupled to the second terminal of the further first master resistor, and further includes a second terminal coupled to the ground potential.

Example 22 provides the current mirror arrangement according to any one of examples 18-21, where a resistance of the further first master resistor is smaller than a resistance of the further second master resistor.

Example 23 provides the current mirror arrangement according to any one of examples 18-22, where a resistance of the further first slave resistor is smaller than a resistance of the further first master resistor, e.g., about K times smaller, when a current gain K of the current mirror is greater than 1, and wherein the resistance of the further first master resistor is smaller than the resistance of the further first slave resistor, e.g., about K times smaller, when the current gain K of the current mirror is less than 1.

Example 24 provides the current mirror arrangement according to any one of examples 18-23, where a resistance of the further second slave resistor is smaller than a resistance of the further second master resistor, e.g., about K times smaller, when a current gain K of the current mirror is greater than 1, and wherein the resistance of the further second master resistor is smaller than the resistance of the further second slave resistor, e.g., about K times smaller, when the current gain K of the current mirror is less than 1.

Example 25 provides a current mirror arrangement that includes a first current mirror and a second current mirror, each current mirror configured to receive a respective input current at an input and generate a respective output current at an output, and each current mirror including an input transistor, an output transistor, and a buffer, where a first terminal of the input transistor is coupled to a first terminal of the output transistor via the buffer, a second terminal of the input transistor is coupled to each of the input and the first terminal of the input transistor, a second terminal of the output transistor is coupled to the output, and a third terminal of the input transistor of the first current mirror is coupled to a third terminal of the input transistor of the second current mirror.

Example 26 provides the current mirror arrangement according to example 25, where a third terminal of the output transistor of the first current mirror is coupled to a third terminal of the output transistor of the second current mirror.

Example 27 provides the current mirror arrangement according to examples 25 or 26, further including one or more resistors coupled to the input transistor of the first current mirror (if 2 or more resistors are coupled then the resistors may be in series with one another), one or more resistors coupled to the output transistor of the first current mirror (if 2 or more resistors are coupled then the resistors may be in series with one another), one or more resistors coupled to the input transistor of the second current mirror (if 2 or more resistors are coupled then the resistors may be in series with one another), and one or more resistors coupled to the output transistor of the second current mirror (if 2 or more resistors are coupled then the resistors may be in series with one another).

Example 28 provides an electronic device that includes an ADC, configured to perform analog-to-digital conversion; and further includes an ADC driver configured to provide a drive signal to the ADC to enable the ADC to perform the analog-to-digital conversion, the ADC driver including the current mirror arrangement according to any one of the preceding examples.

Example 29 provides the electronic device according to example 28, where the electronic device is, or is included in, automatic test equipment, test equipment, military radar/LIDAR, civil radar/LIDAR, automotive radar/LIDAR, industrial radar/LIDAR, cellular base stations, high speed wireline or wireless communication transceivers, or high speed digital control systems.

In other embodiments, the current mirror arrangement according to any one of the preceding examples may be incorporated in other kinds of components of an electronics device, besides being included in an ADC driver. Examples of other components where the current mirror arrangement according to any one of the preceding examples may be incorporated include amplifiers, mixers, and filters, e.g., high-speed amplifiers, high-speed mixers, and high-speed filters. In turn, such components may be included in devices such as automatic test equipment, test equipment, military radar/LIDAR, civil radar/LIDAR, automotive radar/LIDAR, industrial radar/LIDAR, cellular base stations, high speed wireline or wireless communication transceivers, or high speed digital control systems.

Example 30 provides an ADC system that includes an ADC configured to perform analog-to-digital conversion; and an ADC driver configured to provide a drive signal to the ADC to enable the ADC to perform the analog-to-digital conversion, the ADC driver including a current mirror arrangement. The current mirror arrangement includes a current mirror, configured to receive an input current ($I_{IN}$) at an input and provide an output current (IO) at an output, where $IO=K*I_{IN}$, where K is a number greater than 0 (which value may, but does not have to be, an integer), the current mirror including a transistor Q1 and a transistor Q2, where a second terminal of the transistor Q1 is coupled to the input of the current mirror (i.e., coupled to the input current $I_{IN}$), the second terminal of the transistor Q1 is also coupled to the first terminal of the transistor Q1) and a second terminal of the transistor Q2 is coupled to the output of the current mirror (i.e., coupled to the output current 10). The current mirror arrangement further includes a buffer amplifier, having an input coupled to a first terminal of the transistor Q1 and an output coupled to a first terminal of the transistor Q2; a master resistor, where a third terminal of the transistor Q1 is coupled to a first terminal of the master resistor; and a slave resistor, where a third terminal of the transistor Q2 is coupled to a first terminal of the slave resistor. In such an ADC system, a second terminal of each of the master resistor and the slave resistor is coupled to a ground potential, and the drive signal is generated based on the output current provided at the output of the current mirror.

In further examples, the current mirror arrangement of example 30 may be any of the current mirror arrangements according to any one of the preceding examples.

The invention claimed is:

1. An electronic device, comprising a current mirror arrangement, the current mirror arrangement including:

a first portion and a second portion, each including:

a current mirror, configured to receive a respective input current at an input and provide a respective output current at an output, the current mirror comprising a transistor Q1 and a transistor Q2, where a second terminal of the transistor Q1 is coupled to the input of the current mirror and a second terminal of the transistor Q2 is coupled to the output of the current mirror, a buffer amplifier, having an input coupled to a first terminal of the transistor Q1 and an output coupled to a first terminal of the transistor Q2, a master resistor, where a third terminal of the transistor Q1 is coupled to a first terminal of the master resistor, and a slave resistor, where a third terminal of the transistor Q2 is coupled to a first terminal of the slave resistor, where the first terminal of the slave resistor of the first portion is coupled to the first terminal of the slave resistor of the second portion.

2. The electronic device according to claim 1, wherein a second terminal of each of the slave resistor of the first portion and the slave resistor of the second portion is coupled to a ground potential.

3. The electronic device according to claim 2, wherein:

each of the first portion and the second portion further includes a capacitor, and for each of the first portion and the second portion, a first terminal of the capacitor is coupled to the first terminal of the master resistor and a second terminal of the capacitor is coupled to the ground potential.

4. The electronic device according to claim 1, wherein a first terminal of the master resistor of the first portion is coupled to a first terminal of the master resistor of the second portion.

5. The electronic device according to claim 1, wherein a resistance of the slave resistor is smaller than a resistance of the master resistor when a current gain of the current mirror is greater than 1, and wherein the resistance of the master resistor is smaller than the resistance of the slave resistor when the current gain of the current mirror is less than 1.

6. The electronic device according to claim 1, wherein:

each of the first portion and the second portion further includes an additional master resistor, and the third terminal of the transistor Q1 being coupled to the first terminal of the master resistor includes the third terminal of the transistor Q1 being coupled to a first terminal of the additional master resistor and a second terminal of the additional master resistor being coupled to the first terminal of the master resistor.

7. The electronic device according to claim 6, wherein, for each of the first portion and the second portion, a resistance of the additional master resistor is smaller than a resistance of the master resistor.

8. The electronic device according to claim 6, wherein:

each of the first portion and the second portion further includes an additional slave resistor, and the third terminal of the transistor Q2 being coupled to the first terminal of the slave resistor includes the third terminal of the transistor Q2 being coupled to a first terminal of the additional slave resistor and a second terminal of the additional slave resistor being coupled to the first terminal of the slave resistor.

9. The electronic device according to claim 8, wherein a resistance of the additional slave resistor is smaller than a resistance of the additional master resistor when a current gain of the current mirror is greater than 1, and wherein the resistance of the additional master resistor is smaller than the resistance of the additional slave resistor when the current gain of the current mirror is less than 1.

10. The electronic device according to claim 1, wherein:

each of the transistor Q1 and the transistor Q2 is a bipolar transistor, and for each of the transistor Q1 and the transistor Q2, the first terminal is a base terminal, the second terminal is a collector terminal, and the third terminal is an emitter terminal.

11. The electronic device according to claim 1, wherein:

each of the transistor Q1 and the transistor Q2 is a field-effect transistor, and for each of the transistor Q1 and the transistor Q2, the first terminal is a gate terminal, the second terminal is a drain terminal, and the third terminal is a source terminal.

12. The electronic device according to claim 1, wherein the electronic device is a driver for an analog-to-digital converter.

13. The electronic device according to claim 1, wherein the electronic device is a system that includes an analog-to-digital converter (ADC) and a driver for the ADC, and wherein the current mirror arrangement is included in the driver for the ADC.

14. An electronic device, comprising a current mirror arrangement, the current mirror arrangement including:

a current mirror, configured to receive an input current at an input and to provide a mirrored current at an output, the current mirror comprising a transistor Q1 and a transistor Q2;

a buffer amplifier, having an input coupled to a first terminal of the transistor Q1 and an output coupled to a first terminal of the transistor Q2;

a master set, comprising a first master resistor and a second master resistor; and a slave set, comprising a first slave resistor and a second slave resistor, wherein:

a second terminal of the transistor Q1 is coupled to the input of the current mirror, a second terminal of the transistor Q2 is coupled to the output of the current mirror, a third terminal of the transistor Q1 is coupled to a first terminal of the first master resistor, a third terminal of the transistor Q2 is coupled to a first terminal of the first slave resistor, the second master resistor includes a first terminal coupled to a second terminal of the first master resistor, and further includes a second terminal coupled to a ground potential, and the second slave resistor includes a first terminal coupled to a second terminal of the first slave resistor, and further includes a second terminal coupled to the ground potential.

15. The electronic device according to claim 14, wherein:

the master set further includes a master capacitor, the slave set further includes a slave capacitor, the master capacitor includes a first terminal coupled to the second terminal of the first master resistor, and further includes a second terminal coupled to the ground potential, and the slave capacitor includes a first terminal coupled to the second terminal of the first slave resistor, and further includes a second terminal coupled to the ground potential.

16. The electronic device according to claim 15, wherein a capacitance of the slave capacitor is larger than a capacitance of the master capacitor when a current gain of the current mirror is greater than 1, and wherein the capacitance of the master capacitor is larger than the capacitance of the slave capacitor when the current gain of the current mirror is less than 1.

17. The electronic device according to claim 14, wherein a resistance of the first slave resistor is smaller than a resistance of the first master resistor when a current gain of the current mirror is greater than 1, and wherein the resistance of the first master resistor is smaller than the resistance of the first slave resistor when the current gain of the current mirror is less than 1.

18. The electronic device according to claim 14, wherein:

the current mirror arrangement is a differential current mirror arrangement that includes a first signal path and a second signal path, the first signal path includes the current mirror, the buffer amplifier, the master set, and the slave set, where the input current is a first input current ($I_{INP}$), the first input current based on a sum of a bias signal and an input signal, the second signal path includes:

a further current mirror, comprising a further transistor Q1 and a further transistor Q2, the further current mirror configured to receive a second input current ($I_{INM}$) at a further input and provide a further mirrored current (IOM) of the second input current at a further output, where the further mirrored current is based on the second input current and where the second input current is based on a difference between the bias signal and the input signal;

a further buffer amplifier, having an input coupled to a first terminal of the further transistor Q1 and an output coupled to a first terminal of the further transistor Q2;

a further master set, comprising a further first master resistor and a further second master resistor; and a further slave set, comprising a further first slave resistor and a further second slave resistor, and wherein:

a second terminal of the further transistor Q1 is coupled to the further input of the further current mirror, a second terminal of the further transistor Q2 is coupled to the further output of the further current mirror, a third terminal of the further transistor Q1 is coupled to a first terminal of the further first master resistor, a third terminal of the further transistor Q2 is coupled to a first terminal of the further first slave resistor, the further second master resistor includes a first terminal coupled to a second terminal of the further first master resistor, and further includes a second terminal coupled to the ground potential, and the further second slave resistor includes a first terminal coupled to a second terminal of the further first slave resistor, and further includes a second terminal coupled to the ground potential.

19. The electronic device according to claim 18, wherein each of the second terminal of the first master resistor and the first terminal of the second master resistor is coupled to each of the second terminal of the further first master resistor and the first terminal of the further second master resistor.

20. The electronic device according to claim 14, wherein the electronic device is a driver for an analog-to-digital converter.

21. The electronic device according to claim 14, wherein the electronic device is a system that includes an analog-to-digital converter (ADC) and a driver for the ADC, and wherein the current mirror arrangement is included in the driver for the ADC.

* * * * *